US005944609A

United States Patent [19]

Crane et al.

[11] Patent Number: 5,944,609

[45] **Date of Patent: *Aug. 31, 1999**

[54] REMOTE CONTROL SYSTEM FOR OPERATING TOYS

[75] Inventors: John J. Crane, Ramona; William M. Barton, Jr., Encinitas; Paul Eichen, Rancho Santa Fe; Peter C. DeAngelis, Carlsbad; Robert T. Kulakowski, Leucadia, all of Calif.

[73] Assignee: Rokenbok Toy Company, Cardiff, Calif.

[ * ] Notice: This patent is subject to a terminal disclaimer.

[21] Appl. No.: 08/578,210

[22] Filed: Dec. 29, 1995

[51] Int. Cl.[6] ..... A63H 17/39

[52] U.S. Cl. ..... 463/62; 446/454; 446/456

[58] Field of Search ..... 463/40, 62, 63; 446/454, 456, 457, 470, 465, 431, 436, 441, 460

[56] References Cited

U.S. PATENT DOCUMENTS

| | | | |
|---|---|---|---|
| 3,705,387 | 12/1972 | Stern et al. . | |
| 3,722,135 | 3/1973 | Jacobson . | |
| 4,247,107 | 1/1981 | Smith, III et al. | 463/62 |
| 4,406,085 | 9/1983 | Rhodes | 446/456 |
| 4,654,659 | 3/1987 | Kubo | 446/454 |
| 4,938,483 | 7/1990 | Yavetz | 446/456 |

FOREIGN PATENT DOCUMENTS

| | | |
|---|---|---|
| 0227614 | 9/1985 | Germany . |

*Primary Examiner*—Jessica J. Harrison

*Attorney, Agent, or Firm*—Ellsworth R. Roston; Fulwider Patton Lee & Utecht, LLP

[57] ABSTRACT

When manually closed, switches in pads select toy vehicles and the operation of motors for moving the vehicles in different directions and moving upwardly and downwardly (and rightwardly and leftwardly) a receptacle for holding transportable elements (e.g. marbles). When interrogated by a central station, each pad sends through wires to the station signals indicating the switch closures in such pad. Such station produces first binary signals addressing the vehicle selected by such pad and second binary signals identifying the motor control operations in such vehicle. Thereafter the switches identifying in such pad the motor control operations in such selected vehicle can be closed without closing the switches identifying such vehicle. The first and second signals for each vehicle are transmitted by wireless to all of the vehicles at a common carrier frequency modulated by the first and second binary signals. The vehicle identified by the transmitted address demodulates the modulating signals and operates its motors in accordance with such demodulation. When the station fails to receive signals from a pad for a particular period of time, the vehicle selected by such pad can be selected by another pad and such pad can select that vehicle or another vehicle. A cable may couple two (2) central stations (one as a master and the other as a slave) to increase the number of pads controlling the vehicles. Stationary accessories (e.g. elevator) connected by wires to the central station become operative when selected by the pads.

118 Claims, 4 Drawing Sheets

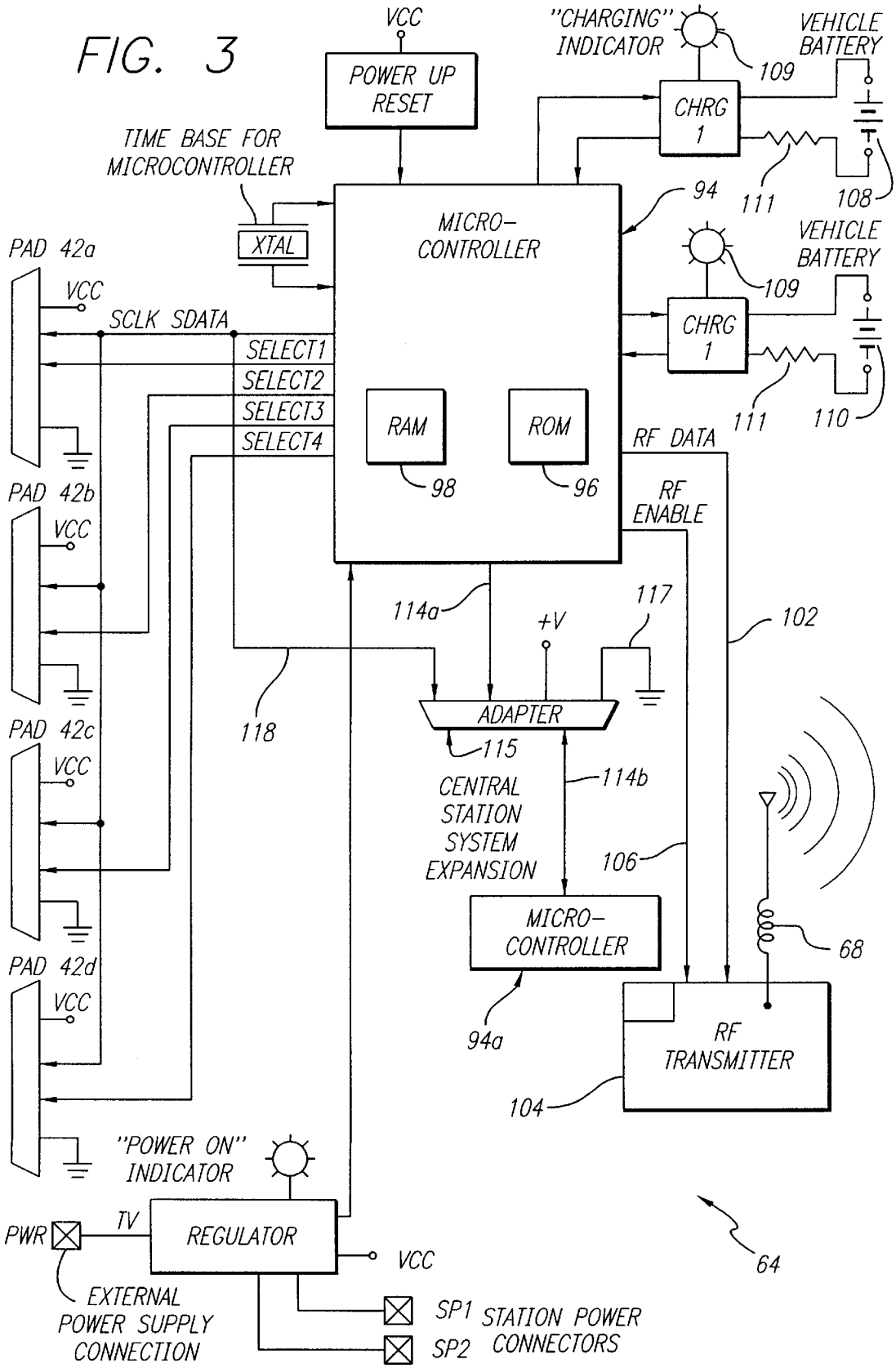
FIG. 3
VCC
POWER UP RESET
"CHARGING" INDICATOR
VEHICLE BATTERY
109
CHRG 1
TIME BASE FOR MICROCONTROLLER
XTAL
MICRO-CONTROLLER
94
111
108
VEHICLE BATTERY
109
CHRG 1
111
110
PAD 42a
VCC
SCLK SDATA
SELECT1
SELECT2
SELECT3
SELECT4
RAM
ROM
98
96
RF DATA
RF ENABLE
PAD 42b
VCC
114a
117
+V
102
118
ADAPTER
115
PAD 42c
VCC
CENTRAL STATION SYSTEM EXPANSION
114b
106
MICRO-CONTROLLER
68
PAD 42d
VCC
94a
RF TRANSMITTER
104
"POWER ON" INDICATOR
PWR
TV
REGULATOR
VCC
64
EXTERNAL POWER SUPPLY CONNECTION
SP1
SP2
STATION POWER CONNECTORS VCC
POWER UP RESET
VCC
122
12
134
TIME BASE FOR MICROCONTROLLER
XTAL
MICRO-CONTROLLER
RAM
ROM
126
124
VEHICLE ADDRESS SELECT
128
130
132
TRANSISTOR DRIVER
4
120
MOTOR 1
28
MOTOR 2
30
MOTOR 3
32
MOTOR 4
33
POWER ON
69
RF POWER MANAGEMENT
RF RECEIVER
121
BATTERY
VCC
4.5V
GND

REMOTE CONTROL SYSTEM FOR OPERATING TOYS

This invention relates to a system for, and method of, operating remotely controlled vehicles simultaneously in a somewhat confined area to provide a pleasurable use by people of all ages with youthful minds. In the system of this invention, the vehicles can be remotely controlled to perform competitive or co-operative tasks. The system of this invention includes pads for operation by the users, vehicles remotely controlled in accordance with the operation of the pads and a central station for co-ordinating the operation of the pads and the vehicles. In addition to the inventive aspects of the system and method discussed above, each of the pads, the central station and the vehicles includes features of an inventive nature. The system of this invention also includes stationary plants (e.g. power plants and elevators) which are controlled by the operation of the pads. The invention additionally relates to methods including methods for controlling the operation of the vehicles on a remotely controlled basis.

BACKGROUND OF THE INVENTION

Various types of play systems exist, and have existed for some time, in which vehicles are moved on a remotely controlled basis. However, such systems generally provide one hand-held unit and one remotely controlled vehicle for operation by the hand-held unit. Examples of a vehicle in such a system are an automobile or an airplane. Furthermore, the functions of the remotely controlled unit, other than movement along a floor or along the ground or in the air, are quite limited.

Other types of play systems involve the use of blocks for building structures. These blocks often include components in the blocks for providing an interlocking relationship between abutting blocks. In this way, elaborate structures can be created by users with creative minds. However, such structures are generally built by hand.

Tests have indicated that there is a desirability, and even a need, for play systems in which vehicles are remotely operated to perform functions other than to move aimlessly along a floor or along the ground. For example, tests have indicated that there is a desirability, and even a need, for a play system in which the remotely controlled vehicles can transport and manipulate elements such as blocks to construct creative structures. There is also a desirability, and even a need for play systems in which a plurality of vehicles can be remotely controlled by elements such as switches in hand-held pads to compete against one another in performing a first task or to co-operate in performing a second task such as building a miniature community through the transport and manipulation of miniature blocks. Such a desirability, or even a need, has existed for a long period of time, probably decades, without a satisfactory resolution.

BRIEF DESCRIPTION OF THE INVENTION

This invention provides a play system for use by people of all ages with youthful minds. It provides for a simultaneous control by each player of an individual one of a plurality of remotely controlled vehicles. This control is provided by the operation by each such player of switches in a hand-held unit or pad to control the movement of an individual one of the remotely controlled vehicles and the performance of different functions (e.g. the movement of blocks or marbles) by such remotely controlled vehicles. Each of the remotely controlled vehicles in the system of this invention can be operated in a competitive or a cooperative relationship with others of the remotely controlled vehicles. The vehicles can be constructed to pick up and transport elements such as blocks or marbles and to deposit such elements at selectively displaced positions.

In one embodiment of the invention, switches in pads control, when manually closed, the selection of toy vehicles and the operation of motors for moving the vehicles forwardly, rearwardly to the left and to the right and moving upwardly and downwardly (and rightwardly and leftwardly) a receptacle for holding transportable elements (e.g. or blocks marbles).

When sequentially and cyclically interrogated by a central station, each pad sends through wires to the station signals indicating the switch closures in such pad. Such station produces first binary signals addressing the vehicle selected by such pad and second binary signals identifying the motor control operations in such vehicle. Thereafter the switches identifying in such pad the motor control operations in such selected vehicle can be closed without closing the switches identifying such vehicle.

The first and second signals for each vehicle are transmitted by wireless to all of the vehicles at a common carrier frequency modulated by the first and second binary signals. The vehicle identified by the transmitted address demodulates the modulating signals and operates its motors to move the vehicle in accordance with such demodulation. When the station fails to receive signals from a pad for a particular period of time, the vehicle selected by such pad becomes available for selection by such pad or by another pad. Furthermore, such pad can select that vehicle or another vehicle.

A cable may couple two (2) central stations (one as a master and the other as a slave) to increase the number of pads controlling by the vehicles. Stationary accessories (e.g. an elevator) connected by wires to the central station become operative when selected by the pads.

BRIEF DESCRIPTION OF THE DRAWINGS

In the drawings:

FIG. 3 is a schematic diagram, primarily in block form, of the different features included in a central station included in the system shown in FIG. 1.

DETAILED DESCRIPTION OF THE INVENTION

Figure 1:
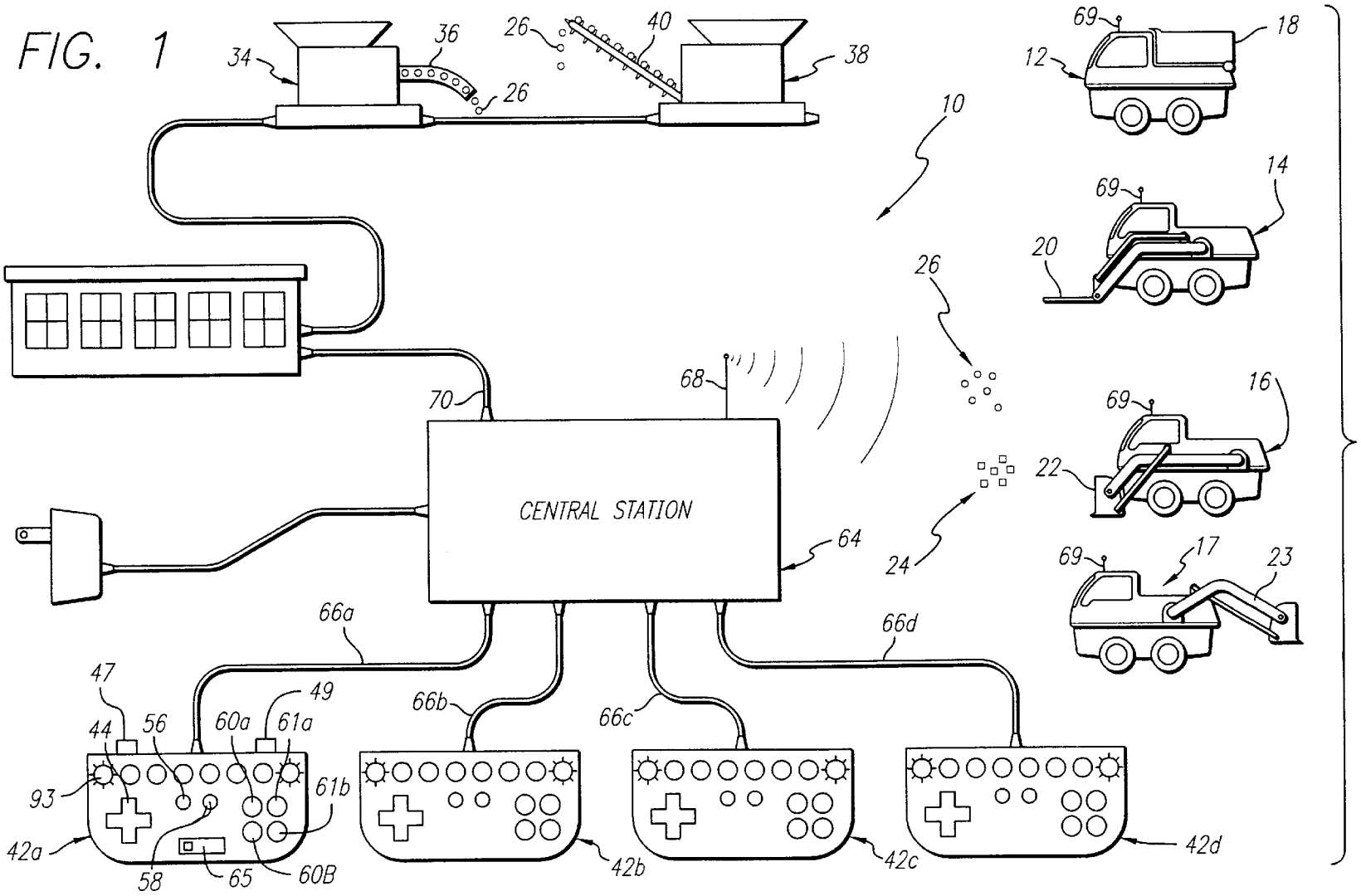
FIG. 1 is a schematic diagram, primarily in block form, of a system constituting one embodiment of the invention.

In one embodiment of the invention, a system generally indicated at 10 in FIG. 1 is provided for controlling the selection and operation of a plurality of toy vehicles. Illustrative examples of toy vehicles constitute a dump truck generally indicated at 12, a fork lift generally indicated at 14, a skip loader generally indicated at 16 and another form of skip loader generally indicated at 17. The toy vehicles such as the dump truck 12, the fork lift 14 and the skip loaders 16 and 17 are simplified versions of commercial units performing functions similar to those performed by the toy vehicles 12, 14, 16 and 17. For example, the dump truck 12 may include a working or transport member such as a pivotable bin or container 18; the fork lift 14 may include a working or transport member such as a pivotable platform 20; the skip loader 16 may include a working or transport member such as a pivotable bin or container 22 disposed at the front end of the skip loader; and the skip loader 17 may include a working or transport member such as a pivotable bin or container 23 disposed at the rear end of the skip loader. The working or transport members such as the pivotable bin or container 18, the pivotable platform 20 and the pivotable bins or containers 22 and 23 are constructed to carry storable and/or transportable elements such as blocks 24 or marbles 26 shown schematically in FIG. 1.

Each of the dump truck 12, the fork lift 14 and the skip loaders 16 and 17 may include a plurality of motors. For example, the dump truck 12 may include a pair of reversible motors 28 and 30 (FIG. 4) operable to move the dump truck forwardly, rearwardly, to the right and to the left. The motor 28 controls the movement of the front and rear left wheels and the motor 30 controls the movement of the front and rear right wheels. Similar motors may be provided for each of the fork lift 14 and the skip loaders 16 and 17.

When the motors 28 and 30 are simultaneously operated in one direction, the dump truck 12 moves forwardly. The vehicle 12 moves rearwardly when the motors 28 and 30 are operated moved in the opposite direction. The vehicle 12 turns toward the right when the motor 30 is operated without a simultaneous operation of the motor 28. The vehicle 12 turns toward the right when the motor 28 is operated without a simultaneous operation of the motor 30.

The vehicle 12 spins to the left when the motor 30 operates to move the vehicle forwardly at the same time that the motor 28 operates to move the vehicle rearwardly. The vehicle 12 spins to the right when the motors 28 and 30 are operated in directions opposite to the operations of the motors in spinning the vehicle to the left.

Another reversible motor 32 in the dump truck 12 operates in one direction to pivot the bin 18 upwardly and in the other direction to pivot the bin downwardly. An additional motor 33 may operate in one direction to turn the bin 18 to the left and in the other direction to turn the bin to the right.

The construction of the motors 28, 30, 32 and 33 and the disposition of the motors in the dump truck 12 to operate the dump truck are considered to be well known in the art. The fork lift 14 and the skip loaders 16 and 17 may include motors corresponding to those described above for the dump truck 12.

The system 10 may also include stationary plants or accessories. For example, the system 10 may include a pumping station generally indicated at 34 (FIG. 1) for pumping elements such as the marbles 26 through a conduit 36. The system may also include a conveyor generally indicated at 38 for moving the elements such as the marbles 26 upwardly on a ramp 40. When the marbles reach the top of the ramp 40, the elements such as the marbles 26 may fall into the bin 18 in the dump truck 12 or into the bin 22 in the skip loader 16. For the purposes of this application, the construction of the pumping station 34 and the conveyor 38 may be considered to be within the purview of a person of ordinary skill in the art.

The system 10 may also include a plurality of hand-held pads generally indicated at 42*a*, 42*b*, 42*c* and 42*d* (FIG. 1). Each of the pads 42*a*, 42*b*, 42*c* and 42*d* may have a substantially identical construction. Each of the pads may include a plurality of actuatable buttons. For example, each of the pads may include a 4-way button 44 in the shape of a cross. Each of the different segments in the button 42 is connected to an individual one of a plurality of switches 46, 48, 50 and 52 in FIG. 2.

When the button 44 is depressed at the segment at the top of the button, the switch 46 is closed to obtain the operation of the motors 28 and 30 (FIG. 4) in moving the vehicle 12 forwardly. Similarly, when the segment at the bottom of the button 44 is depressed, the switch 48 is closed to obtain the operation of the motor 28 and 30 (FIG. 4) in moving the vehicle 12 rearwardly. The selective depression of the right and left segments of the button 44 cause the motors 28 and 30 to operate spinning the vehicle in individual ones of the two (2) opposite directions.

It will be appreciated that pairs of segments of the button 44 may be simultaneously depressed. For example, the top and left portions of the button 44 may be simultaneously depressed to obtain a simultaneous movement of the vehicle 12 forwardly and to the left. However, a simultaneous actuation of the top and bottom segments of the button 44 will not have any effect since they represent contradictory commands. This is also true of a simultaneous depression of the left and right segments of the button 44.

Figure 2:
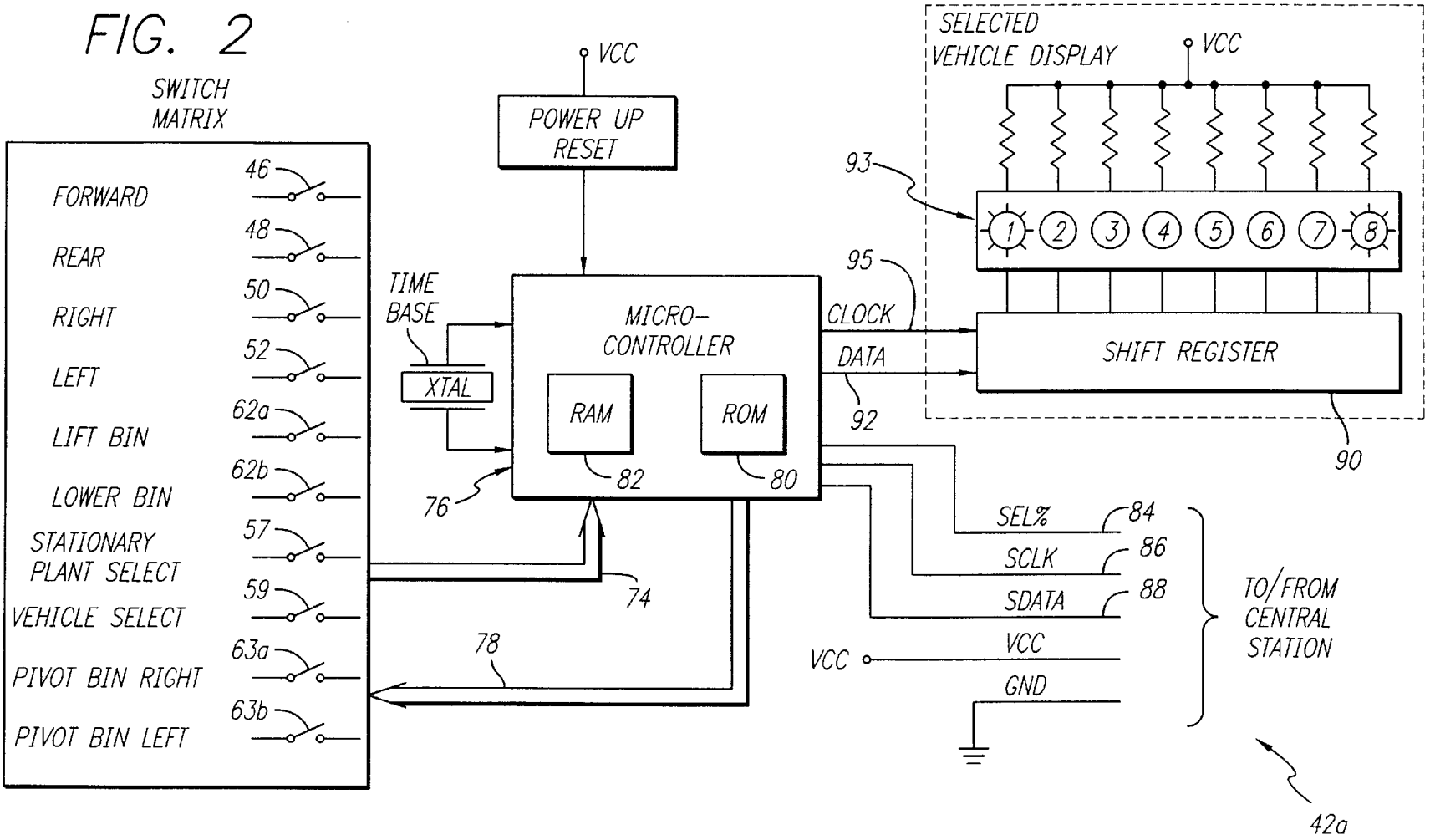
FIG. 2 is a schematic diagram, primarily in block form, of the different features in a pad included in the system shown in FIG. 1.

Each of the pads 42*a*, 44*b*, 42*c* and 42*d* may include a button 56 (FIG. 1) which is connected to a switch 57 (FIG. 2). Successive depressions of the button 56 on one of the pads within a particular period of time cause different ones of the stationary accessories or plants such as the pumping station 34 and the conveyor 38 to be energized. For example, a first depression of the button 56 in one of the pads 42*a*, 42*b*, 42*c* and 42*d* may cause the pumping station 34 to be energized and a second depression of the button 56 in such pad within the particular period of time may cause the conveyor 38 to be energized instead of the pumping station. When other stationary accessories are included in the system 10, each may be individually energized by depressing the button 56 a selective number of times within the particular period of time. This energizing of a selective one of the stationary accessories occurs at the end of the particular period of time. An adder is included in the pad 12 to count the number of depressions of the button 56 within the particular period of time.

A button 58 is provided in each of the pads 42*a*, 42*b*, 42*c* and 42*d* to select one of the vehicles 12, 14, 16 and 17. The individual one of the vehicles 12, 14, 16 and 17 selected at any instant by each of the pads 42*a*, 42*b*, 42*c* and 42*d* is dependent upon the number of times that the button is depressed in that pad within a particular period of time. For example, one (1) depression of the button 58 may cause the dump truck 12 to be selected and two (2) sequential selections of the button 58 within the particular period of time may cause the fork lift 14 to be selected.

Every time that the button 58 is actuated or depressed within the particular period of time, a switch 59 (in FIG. 2) is closed. The particular period of time for depressing the button 58 may be the same as, or different from, the particular period of time for depressing the button 56. An adder is included in the pad 12 to count the number of depressions of the button 58 within the particular period of time. This count is converted into a plurality of binary signals indicating the count. The count is provided at the end of the particular period of time.

Buttons 60*a* and 60*b* are also included on each of the pads 42*a*, 42*b*, 42*c* and 42. When depressed, the buttons 60*a* and 60*b* respectively close switches 62*a* and 62*b* in FIG. 2. The closure of the switch 62*a* is instrumental in producing an operation of the motor 32 in a direction to lift the bin 18 in the dump truck 12 when the dump truck has been selected by the proper number of depressions of the button 58. In like manner, when the dump truck 12 has been selected by the proper number of depressions of the switch 58, the closure of the switch 62*b* causes the selective one of the bin 18 in the dump truck 12, the platform 20 in the fork lift 14 and the bin 22 in the skip loader 16 and the bin 23 in the skip loader 17 to move downwardly as a result of the operation of the motor 32 in the reverse direction.

It will be appreciated that other controls may be included in each of the pads 42*a*, 42*b*, 42*c* and 42*d*. For example, buttons 61*a* and 61*b* may be included in each of the pads 42*a*, 42*b*, 42*c* and 42*d* to pivot the bin 18 to the right or left when the vehicle 12 has been selected. Such movements facilitate the ability of the bin 18 to scoop elements such as the blocks 24 and the marbles 26 upwardly from the floor or ground or from any other position and to subsequently deposit such elements on the floor or ground or any other position.

Switches 63*a* and 63*b* (FIG. 2) are respectively provided in the pad 42*a* in association with the buttons 61*a* and 61*b* and are closed by the respective actuation of the buttons 61*a* and 61*b* to move the bin or the platform in the vehicle 12 to the left or right when the vehicle has been selected. It will be appreciated that different combinations of buttons may be actuated simultaneously to produce different combinations of motions. For example, a bin in a selected one of the vehicles may be moved at the same time that the selected one of the vehicles is moved.

A central station generally indicated at 64 in FIG. 1 processes the signals from the individual ones of the pads 42*a*, 42*b*, 42*c* and 42*d* and sends the processed signals to the vehicles 12, 14, 16 and 17 when the button 58 on an individual one of the pads has been depressed to indicate that the information from the individual ones of the pads is to be sent to the vehicles. The transmission may be on a wireless basis from an antenna 68 (FIG. 1) in the central station to antennas 69 on the vehicles.

The transmission may be in packets of signals. This transmission causes the selected ones of the vehicles 12, 14, 16 and 17 to perform individual ones of the functions directed by the depression of the different buttons on the individual ones of the pads. When the commands from the individual ones of the pads 42*a*, 42*b*, 42*c* and 42*d* are to pass to the stationary accessories 34 and 38 as a result of the depression of the buttons 56 on the individual ones of the pads, the central station processes the commands and sends signals through cables 70 to the selected ones of the stationary accessories.

FIG. 2 shows the construction of the pad 42*a* in additional detail. It will be appreciated that each of the pads 42*b*, 42*c* and 42*d* may be constructed in a substantially identical manner to that shown in FIG. 2. As shown in FIG. 2, the pad 42*a* includes the switches 46, 48, 50 and 52 and the switches 57, 59, 62*a*, 62*b*, 63*a* and 63*b*. Buses 74 are shown as directing indications from the switches 46, 48, 50, 52, 57, 59, 62*a*, 62*b*, 63*a* and 63*b* to a microcontroller generally indicated at 76 in FIG. 2. Buses 78 are shown for directing signals from the microcontroller 76 to the switches in the pad 42.

The microcontroller 76 is shown as including a read only memory (ROM) 80 and a random access memory (RAM) 82. Such a microcontroller may be considered to be standard in the computing industry. However, the programming in the microcontroller and the information stored in the read only memory 80 and the random access memory 82 are individual to this invention.

The read only memory 80 stores permanent information and the random access memory stores volatile (or impermanent) information. For example, the read only memory 80 may store the sequence in which the different switches in the pad 42*a* provide indications of whether or not they have been closed. The random access memory 82 may receive this sequence from the read only memory 80 and may store indications of whether or not the switches in the particular sequence have been closed for each individual one of the pads 42*a*, 42*b*, 42*c* and 42*d*.

The pad 42*a* in FIG. 2 receives the interrogating signals from the central station 64 through a line 84. These interrogating signals are not synchronized by clock signals on a line 86. Each of the interrogating signals intended for the pad 42*a* may be identified by an address individual to such pad. When the pad 42*a* receives such interrogating signals, it sends to the central station 64 through lines 88 a sequence of signals indicating the status of the successive ones of the switches 46, 48, 50 and 52 and the switches 57, 59, 62*a*, 62*b*, 63*a* and 63*b*. These signals are synchronized by the clock signals on the line 86. It will be appreciated that the status of each of the switches 57 and 59 probably is the first to be provided in the sequence since these signals indicate the selection of the stationary accessories 34 and 38 and the selection of the vehicles 12, 14, 16 and 17.

As previously indicated, the pad 42*a* selects one of the vehicles 12, 14, 16 and 17 in accordance with the number of closings of the switch 59. As the user of the pad 42*a* provides successive actuations or depressions of the button 58, signals are introduced to a shift register 90 through a line 92 to indicate which one of the vehicles 12, 14, 16 and 17 would be selected if there were no further depressions of the button. Each one of the depressions of the button 58 causes the indication to be shifted to the right in the shift register 90. Such an indication is provided on an individual one of a plurality of light emitting diodes (LED) generally indicated at 93. The shifting of the indication in the shift register 90 may be synchronized with a clock signal on a line 95. Thus, the illuminated one of the light emitting diodes 92 at each instant indicates at that instant the individual one of the vehicles 42*a*, 42*b*, 42*c* and 42*d* that the pad 42*a* has selected at such instant.

The central station 64 is shown in additional detail in FIG. 3. It includes a microcontroller generally indicated at 94 having a read only memory (ROM) 96 and a random access memory (RAM) 98. As with the memories in the microcontroller 76 in the pad 42*a*, the read only memory 96 stores permanent information and the random access memory 98 stores volatile (or impermanent) information. For example, the read only memory 96 sequentially selects successive ones of the pads 42*a*, 42*b*, 42*c* and 42*d* to be interrogated on a cyclic basis. The read only memory 96 also stores a plurality of addresses each individual to a different one of the vehicles 12, 14, 16 and 17.

Since the read only memory 96 knows which one of the pads 42*a*, 42*b*, 42*c* and 42*d* is being interrogated at each instant, it knows the individual one of the pads responding at that instant to such interrogation. The read only memory 96 can provide this information to the microcontroller 94 when the microcontroller provides for the transmittal of information to the vehicles 12, 14, 16 and 17. Alternatively, the microcontroller 76 in the pad 42*a* can provide an address indicating the pad 42*a* when the microcontroller sends the binary signals relating to the status of the switches 46, 48, 50 and 52 and the switches 57, 59, 62*a*, 62*b*, 63*a* and 63*b* to the central station 64.

As an example of the information stored in the random access memory 98 in FIG. 3, the memory stores information relating to each pairing between an individual one of the pads 42*a*, 42*b*, 42*c* and 42*d* and a selective one of the vehicles 12, 14, 16 and 17 in FIG. 1 and between each individual one of such pads and a selective one of the stationary accessories 34 and 38. The random access memory 98 also stores the status of the operation of the switches 46, 48, 50 and 52 for each pad and the operation of the switches 57, 59, 62*a*, 62*b*, 63*a* and 63*b* for each pad.

When the central station 64 receives from the pad 42*a* the signals indicating the closure (or the lack of closure) of the switches 46, 48, 50 and 52 and the switches 57, 59, 62*a*, 62*b*, 63*a* and 63*b*, the central station retrieves from the read only memory 96 the address of the individual one of the vehicles indicated by the closures of the switch 59 in the pad. The central station may also retrieve the address of the pad 42*a* from the read only memory 96.

The central station 64 then formulates in binary form a composite address identifying the pad 42*a* and the selected one of the vehicles 12, 14, 16 and 17 and stores this composite address in the random access memory 98. The central station 64 then provides a packet or sequence of signals in binary form including the composite address and including the status of the opening and closing of each of the switches in the pad 42*a*. This packet or sequence indicates in binary form the status of the closure each of the switches 46, 48, 50 and 52 and the switches 57, 59, 62*a*, 62*b*, 63*a* and 63*b*.

Each packet of information including the composite addresses and the switch closure information for the pad 42*a* is introduced through a line 102 in FIG. 3 to a radio frequency transmitter 104 in the central station 64. The radio frequency transmitter 104 is enabled by a signal passing through a line 106 from the microcontroller 94. This enabling signal is produced by the microcontroller 94 when the microcontroller confirms that it has received signals from the pad 42*a* as a result of the interrogating signals from the central station 64.

When the radio frequency transmitter 104 receives the enabling signal on the line 106 and the address and data signals on the line 102, the antenna 68 (also shown in FIG. 1) transmits signals to all of the vehicles 12, 14, 16 and 17. However, only the individual one of the vehicles 12, 14, 16 and 17 with the address indicated in the packet of signals from the central station 64 will respond to such packet of signals.

The microcontroller 94 stores in the random access memory 98 the individual ones of the vehicles such as the vehicles 12, 14 and 16 being energized at each instant by the individual ones of the pads 42*a*, 42*b*, 42*a* and 42*d*. Because of this, the central station 64 is able to prevent the interrogated one of the pads 42*a*, 42*b*, 42*c* and 42*d* from selecting one of the energized vehicles. Thus, for example, if the vehicle 14 is being energized by one of the pads 42*a*, 42*b*, 42*c* and 42*d* at a particular instant, a first depression of the button 58 in the pad being interrogated at that instant will cause the vehicle 12 to be initially selected and a second depression of the button by such pad will cause the vehicle 14 to be skipped and the vehicle 16 to be selected.

Furthermore, in the example above where the pad 42*a* has previously selected the vehicle 14, the microcomputer 94 in the central station 64 will cause the vehicle 14 to be released when the pad 42*a* thereafter selects any of the vehicles 12, 16 and 17. When the vehicle 14 becomes released, it becomes available immediately thereafter to be selected by any one of the pads 42*a*, 42*b*, 42*c* and 42*d*. The release of the vehicle 14 by the pad 42*a* and the coupling between the pad 42*a* and a selected one of the vehicles 12, 16 and 17 are recorded in the random access memory 98 in the microcontroller 94.

The vehicles 12, 14, 16 and 17 are battery powered. As a result, the energy in the batteries in the vehicles 12, 14, 16 and 17 tends to become depleted as the batteries provide the energy for operating the vehicles. The batteries in the vehicles 12 and 14 are respectively indicated at 108 and 110 in FIG. 3. The batteries 108 and 110 are chargeable by the central station 64 because the central station may receive AC power from a wall socket. The batteries are charged only for a particular period of time. This particular period of time is preset in the read only memory 96. When each battery is being charged for the particular period of time, a light 109 in a circuit with the battery becomes illuminated. The charging current to each of the batteries 108 and 110 may be limited by a resistor 111. The light 109 becomes extinguished when the battery has been charged.

Each central station 64 may have the capabilities of servicing only a limited number of pads. For example, each central station 64 may have the capabilities of servicing only the four (4) pads 42*a*, 42*b*, 42*c* and 42*d*. It may sometimes happen that the users of the system may wish to be able to service more than four (4) pads. Under such circumstances, the microcontroller 94 in the central station 64 and a microcontroller, generally indicated at 94*a*, in a second central station corresponding to the central station 64 may be connected by cables 114*a* and 114*b* to an adaptor generally indicated at 115.

One end of the cable 114*a* is constructed so as to be connected to a ground 117 in the adaptor 115. This ground operates upon the central station to which it is connected so that such central station is a slave to, or subservient to, the other central station. For example, the ground 117 in the adaptor 115 may be connected to the microcomputer 94*a* so that the central station including the microcomputer 94*a* is a slave to the central station 64. When this occurs, the microcontroller 94 in the central station 64 serves as the master for processing the information relating to the four (4) pads and the four (4) vehicles in its system and the four (4) pads and the four (4) vehicles in the other system.

The expanded system including the microcomputers 94 and 94*a* may be adapted so that the address and data signals generated in the microcomputer 94*a* may be transmitted by the antenna 68 in the central station 64 when the central station 64 serves as the master station. The operation of the central station 64*a* may be clocked by the signals extending through a line 118 from the central station 64 to the adaptor 115 and through a corresponding line from the other central station to the adaptor.

Figure 4:
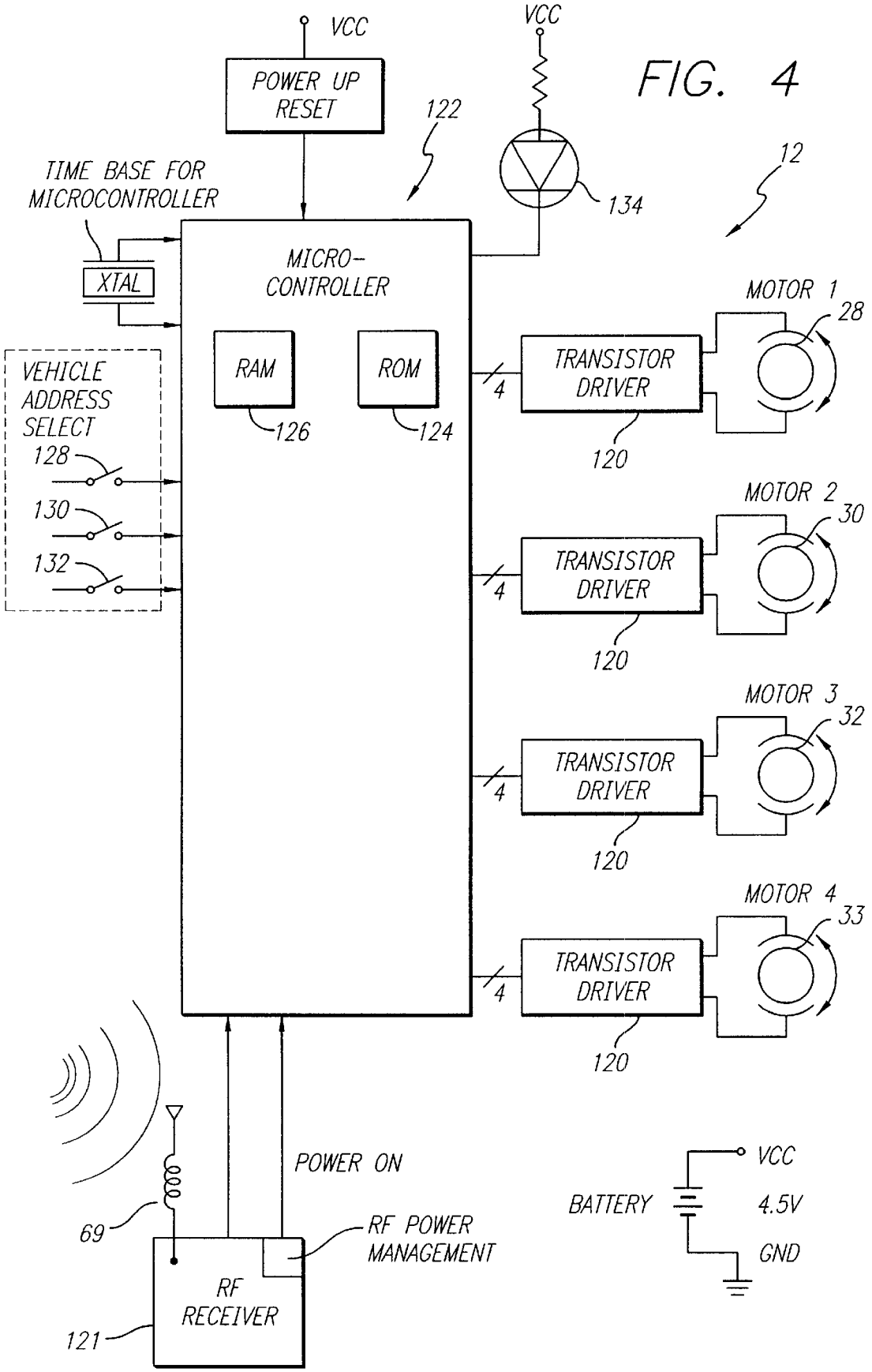
FIG. 4 is a schematic diagram, primarily in block form, of the different features in a vehicle included in the system shown in FIG. 1.

The vehicle 12 is shown in additional detail in FIG. 4. Substantially identical arrangements may be provided for the vehicles 14, 16 and 17. The vehicle 12 includes the antenna 69 for receiving from the central station 64 signals with the address of the vehicle and also includes a receiver 121 for processing the received signals. The vehicle 12 also includes the motors 28, 30, 32 and 33. Each of the motors 28, 30, 32 and 33 receives signals from an individual one of transistor drivers 120 connected to a microcontroller generally indicated at 122.

The microcontroller 122 includes a read only memory (ROM) 124 and a random access memory (RAM) 126. As with the memories in the pad 42*a* and the central station 64, the read only memory 124 may store permanent information and the random access memory 126 may store volatile (or impermanent) information. For example, the read only memory 124 may store information indicating the sequence of the successive bits of information in each packet for controlling the operation of the motors 28, 30, 32 and 33 in the vehicle 12. The random access memory 126 stores information indicating whether there is a binary 1 or a binary 0 at each successive bit in the packet.

The vehicle 12 includes a plurality of switches 128, 130 and 132. These switches are generally pre-set at the factory to indicate a particular Arabian number such as the number "5". However, the number can be modified by the user to indicate a different number if two central stations are connected together as discussed above and if both stations have vehicles identified by the numeral "5". The number can be modified by the user by changing the pattern of closure of the switches 128, 130 and 132. The pattern of closure of the switches 128, 130 and 132 controls the selection of an individual one of the vehicles such as the vehicles 12, 14, 16 and 17.

The pattern of closure of the switches 128, 130 and 132 in one of the vehicles can be changed when there is only a single central station. For example, the pattern of closure of the switches 128, 130 and 132 can be changed when there is only a single central station with a vehicle identified by the numeral "5" and when another user brings to the central station, from such other user's system, another vehicle identified by the numeral "5".

The vehicle 12 also includes a light such as a light emitting diode 130. This diode is illuminated when the vehicle 12 is selected by one of the pads 42*a*, 42*b*, 42*c* and 42*d*. In this way, the other users can see that the vehicle 12 has been selected by one of the pads 42*a*, 42*b*, 42*c* and 42*d* in case one of the users (other than the one who selected the vehicle 12) wishes to select such vehicle. It will be appreciated that each of the vehicles 12, 14, 16 and 17 may be generally different from the others so each vehicle may be able to perform functions different from the other vehicles. This is another way for each user to identify the individual one of the vehicles that the user has selected.

As previously indicated, the user of one of the pads such as the pad 42*a* selects the vehicle 12 by successively depressing the button 58 a particular number of times within a particular time period. This causes the central station 64 to produce an address identifying the vehicle 12. When this occurs, the central station 64 stores information in its random access memory 98 that the pad 42*a* has selected the vehicle 12. Because of this, the user of the pad 42*a* does not thereafter have to depress the button 58 during the time that the pad 42*a* is directing commands through the station 64 to the vehicle 12. As long as the buttons on the pad 42*a* are thereafter depressed within a particular period of time to command the vehicle 12 to perform individual functions, the microprocessor 94 in the central station 64 will direct the address of the vehicle to be retrieved from the read only memory 96 and to be included in the packet of the signals transmitted by the central station to the vehicle 12.

The read only memory 96 in the microprocessor 94 at the central station 64 stores information indicating a particular period of time in which the vehicle 12 has to be addressed by the pad 42*a* in order for the selective coupling between the pad and the vehicle to be maintained. The random access memory 98 in the microcontroller 94 stores the period of time from the last time that the pad 42*a* has issued a command through the central station 64 to the vehicle 12. When the period of time in the random access memory 98 equals the period of time in the read only memory 96, the microcontroller 94 will no longer direct commands from the pad 42*a* to the vehicle 12 unless the user of the pad 42 again depresses the button 58 the correct number of times within the particular period of time to select the vehicle 12.

The vehicle 12 also stores in the read only memory 124 indications of the particular period of time in which the vehicle 12 has to be addressed by the pad 42*a* in order for the selective coupling between the vehicle and the pad to be maintained. This period of time is the same as the period of time specified in the previous paragraph. The random access memory 126 in the microcontroller 122 stores the period of time from the last time that the pad 42*a* has issued a command to the vehicle 12.

As previously indicated, the button 58 in the pad 42*a* does not have to be actuated or depressed to issue the command after the pad 42*a* has initially issued the command by the appropriate number of depressions of the button. When the period of time stored in the random access memory 126 of the microcomputer 122 in the vehicle equals the period of time in the read only memory 124, the microcontroller 122 issues a command to extinguish the light emitting diode 130. This indicates to the different users of the system, including the user previously controlling the operation of the vehicle 121 that the vehicle is available to be s elected by one of the users including the user previously directing the operation of the vehicle.

When one of the vehicles such as the vehicle 12 is being moved in the forward direction, the random access memory 126 records the period of time during which such forward movement of the vehicle 12 is continuously occurring. This period of time is continuously compared in the microcontroller 122 with a fixed period of time recorded in the read only memory 124. When the period of time recorded in the random access memory 126 becomes equal to the fixed period of time recorded in the read only memory 124, the microcontroller 122 provides a signal for increasing the speed of the movement of the vehicle 12 in the forward direction. Similar arrangements are provided for each of the vehicles 14, 16 and 17. This increased speed may illustratively be twice that of the original speed.

The system and method described above have certain important advantages. They provide for the operation of a plurality of vehicles by a plurality of users, either on a competitive or a co-operative basis. Furthermore, the vehicles can be operated on a flexible basis in that a vehicle can be initially selected for operation by one user and can then be selected for operation by another user after the one user has failed to operate the vehicle for a particular period of time. The vehicles being operated at each instant are also visible by the illumination of the lights 130 on the vehicle. The apparatus and method of this invention are also advantageous in that the vehicles are operated by the central station 64 on a wireless basis without any physical or cable connection between the central station and the vehicles.

Furthermore, the central station 64 is able to communicate with the vehicles in the plurality through a single carrier frequency. The system and method of this invention are also advantageous in that the vehicles can selectively perform a number of different functions including movements forwardly and rearwardly and to the left and the right and including movements of a container or bin or platform on the vehicle upwardly and downwardly or to the left or the right. Different movements can also be provided simultaneously on a coordinated basis.

There are also other significant advantages in the system and method of this invention. Two or more systems can be combined to increase the number of pads 142 controlling the operation of the vehicles 12, 14 16 and 17. In effect, this increases the number of users capable of operating the system. This combination of systems can be provided so that one of the systems is a master and the other is a slave. This prevents any confusion from occurring in the operation of the system. The system is also able to recharge the batteries in the vehicles so that use of the vehicles can be resumed after the batteries have been charged.

The system and method of this invention are also advantageous in the provision of the pads and the provision of the button and switches in the pads. As will be appreciated, the pads are able to select vehicles and/or stationary accessories through the operation of a minimal number of buttons and to provide for the operation of a considerable number of different functions in the vehicles with a minimal number of buttons. In co-operation with the central station, the pads are able to communicate the selection of vehicles to the central station without indicating to the station, other than on a time shared basis, the identities of the vehicles being selected.

After selecting a vehicle, each pad does not thereafter have to indicate the identity of the vehicle as long as the pad operates the vehicle through the central station within a particular period of time from the last operation of the vehicle by the pad through the central Under such circumstances, it is sufficient for the pad to identify its own address to the selected vehicle within the particular period of time in order to continue to operate the selected vehicle.

Although this invention has been disclosed and illustrated with reference to particular embodiments, the principles involved are susceptible for use in numerous other embodiments which will be apparent to persons of ordinary skill in the art. The invention is, therefore, to be limited only as indicated by the scope of the appended claims.

We claim:

1. In combination, a plurality of motorized vehicles each having an address and first controls to provide a movement of the vehicle in different directions in accordance with the operation of the first controls and each having at least one member operable to perform functions and each having second controls to obtain the performance of the functions by the operable member, a plurality of pads each having a plurality of switches for controlling the addressing of any one of the motorized vehicles and controlling the movements of the addressed vehicle and the operation of the operable member in the addressed motorized vehicle, first means responsive to the operations of the switches in each of the pads for addressing any one of the motorized vehicles and for providing for movements of the addressed motorized vehicle and for the operation of the operable member in the addressed motorized vehicle, and the first means being displaced from the pads and the vehicles, second means in the first means for interrogating the pads to determine the operation of the switches in the pads and for receiving the signals from the interrogated pads and for producing signals representing the addresses of the vehicles selected by the pads and representing the movements of the vehicles and the operation of the operable member in the addressed vehicles, third means disposed in the motorized vehicles and responsive to the signals indicating the addresses produced by the second means for energizing the addressed vehicles and responsive to the signals indicating the operation of the switches in the pads for producing the movements of the addressed vehicles and for producing the operations of the operable members in the addressed vehicles, and fourth means in the first means for providing for the movements of the addressed vehicles and for the operations of the operable members in the addressed vehicles after the addressing of the vehicles even when the motorized vehicles are not thereafter addressed by the pads controlling the operation of the vehicles but when the pads are operated to provide for the movements of the addressed motorized vehicles or for the operation of the operable member in the addressed motorized vehicles.

2. In a combination as set forth in claim 1, the second means being operative to produce the signals for the addressed motorized vehicles at a common carrier frequency and for modulating the signals at the common carrier frequency in accordance with the operation of the switches in the pads, and the third means being disposed at the addressed motorized vehicles for operating upon the signals at the common carrier frequency to energize the addressed motorized vehicles and to produce the movements of the addressed motorized vehicles and to produce the operations of the operable members in the addressed motorized vehicles, the first means being connected to the pads to provide power to the pads and to communicate with the pads and the first means communicating by wireless with the vehicles.

3. In a combination as set forth in claim 1 wherein the first means constitutes a central station connected by wires to the pads and having a wireless relationship with the vehicles.

4. In combination, a plurality of motorized vehicles each having first controls to provide a movement of the vehicle in different directions in accordance with the operation of the first controls and each having a member operable to perform functions and each having second controls to obtain the performance of the functions by the member, a plurality of pads each having a plurality of switches for controlling the addressing of any one of the motorized vehicles and for controlling the energizing of the first and second controls in the addressed motorized vehicle, a central station responsive to the operation of the switches in the pads for providing for an operation of the first and second controls in the addressed vehicles, the central station including means for interrogating the pads in the plurality to determine if there is an operation of the switches in the pads and including means for communicating the operation of the switches in the pads to the vehicles to obtain the operation of the addressed vehicles in accordance with the operation of the switches, and means in the central station for releasing each of the vehicles from addressing by the pad addressing the vehicle when the second controls in the pads are not operated for a particular period of time to obtain the operation of the addressed vehicles and when the pad is the only pad addressing the vehicle.

5. In a combination as set forth in claim 4, the central station including means for retaining a communication previously established between the pads and the vehicles when there is an operation, within a particular period of time after the last previous communication between the pads and the vehicles, of the switches in the pads during the interrogation of the pads in the plurality and for discontinuing the communication when there is not an operation of the switches in the pads within the particular period of time.

6. In a combination as recited in claim 4, each of the vehicles having an address, and the central station providing common carrier signals for communication with the vehicles and providing on the carrier signals modulations providing the addresses of the addressed vehicles and identifying the operation of the switches in the pads.

7. In combination in a vehicle for use with control means having properties of providing packets of signals, each packet including a binary address and binary signals identifying the operations to be provided in the vehicle, wheels on the vehicle for moving the vehicle, first means operable for propelling the vehicle forwardly and rearwardly and for turning the vehicle in opposite directions, an operable member disposed on the vehicle, second means in the vehicle for operating the operable member, first controls energizable in the vehicle to provide movements of the vehicle by the first means forwardly and rearwardly and to provide turnings of the vehicle by the first means in the opposite directions, second controls energizable in the vehicle to provide an operation of the operable member, third means in the vehicle for receiving the packets of signals transmitted from the control means, the packets of signals including a binary address addressing the vehicle and binary signals indicating the energizing of the first and second controls in the vehicle, fourth means in the vehicle for recovering the packets with the address of the vehicle, fifth means in the vehicle for decoding, in the packets with the address of the vehicle, the binary signals indicating the energizing of the first and second controls, sixth means in the vehicle for energizing the first and second means in accordance with the decoding by the fifth means of the binary signals indicating the energizing of the first and second controls, seventh means operatively coupled in the vehicle to the first means and responsive to the decoding of the binary signals by the fifth means for providing an initial movement of the vehicle at a first speed, and eighth means responsive in the vehicle to the continued movement of the vehicle at the first speed for a particular period of time for changing the speed of movement of the vehicle to a second speed.

8. In a combination as set forth in claim 7, means disposed on the vehicle for providing an indication that the vehicle has been energized by the packets from the control means.

9. In a combination as forth in claim 7, the control means being included in a central station, the packets of the binary signals being transmitted from the central station, the receiving means in the vehicle receiving the packets of the binary signals transmitted from the central station, the packets including the binary address identifying the vehicle and the binary signals indicating the energizing of the first and second controls in the vehicle.

10. In a combination as set forth in claim 7 wherein the second means is motive and wherein the second means is movable in opposite directions.

11. In combination for use with control means having properties of providing packets of signals from a plurality of controlling, members each packet including a binary address and binary signals identifying the energizing of different controls, a toy vehicle displaced from the control means, wheels on the vehicle for moving the vehicle, first means selectively operable in the vehicle for propelling the vehicle forwardly and rearwardly and for turning the vehicle in opposite directions, an operable member disposed on the vehicle, second means disposed on the vehicle for operating the operable member, first controls operable in the vehicle to provide movements of the vehicle by the first means forwardly and rearwardly and to provide turnings of the vehicle by the first means in the opposite directions, second controls operable in the vehicle to provide an operation of the operable member, third means in the vehicle for receiving the packets of signals from the control means, the packets of signals including a binary address identifying the vehicle and binary signals indicating the energizing of the first and second controls in the vehicle, fourth means in the vehicle for recovering the packets with the binary address of the vehicle, fifth means in the vehicle for recovering, in the packets with the binary address of the vehicle, the binary signals indicating the energizing of the first and second controls, sixth means in the vehicle for energizing the first and second means in accordance with the binary signals indicating the energizing of the first and second controls, and seventh means responsive in the vehicle to the failure of the vehicle to receive for a particular period of time the packets of signals, including the binary address of the vehicle, from the control means for providing for a de-coupling of the vehicle from addressing by the control means until the control means thereafter provides the packets of signals with the binary address of the vehicle from any one of the controlling members.

12. In combination, a central station for use with a plurality of pads each having a plurality of operable controls and for use with a plurality of vehicles each addressable in accordance with the operation of a first one of the controls in one of the pads and each operable to perform functions in accordance with the operation of second ones of the controls in the pad, first means in the central station for receiving from the pads signals indicating the addressing of the vehicles by the pads and indicating the operation of the first and second controls in the pads, second means responsive in the central station to the signals indicating the addressing of the vehicles by the pads for addressing the vehicles, third means responsive in the central station to the production by the second means of the addresses identifying the vehicles for transmitting signals representing the addresses of the vehicles and signals indicating the operation of the second controls in the pads, the central station constituting a first central station, a second central station including first means, second means and third means in the second central station respectively corresponding to the first, second and third means in the first central station, and fourth means for connecting the first and second central stations in a relationship to provide for the operation of the first, second and third means in one of the central stations under the control of the other one of the central stations.

13. In combination in a central station for use with a plurality of pads each having a plurality of operable controls and for use with a plurality of vehicles each addressable in accordance with the operation of a first one of the controls in the pads and each operable to perform functions in accordance with the operation of second ones of the controls in the pads, first means for receiving from the pads signals indicating the addressing of the vehicles by the pads and indicating the operation of the first and second controls in the addressed pads, second means responsive to the signals indicating the addressing of the vehicles by the pads for producing addresses identifying the pads and identifying the vehicles addressed by the pads, third means responsive to the production by the second means of the addresses identifying the vehicles for transmitting signals representing the addresses of the vehicles and signals indicating the operation of the controls in the pads to obtain the performance of the functions in the vehicles, means for charging the vehicles, and means for terminating the charging of the vehicles after the vehicles have been charged for a particular period of time.

14. In combination in a central station for use with a plurality of pads each having a plurality of operable controls and for use with a plurality of vehicles each addressable in accordance with the operation of a first one of the controls in the pads and each operable to perform functions in accordance with the operation of second ones of the controls in the pads, first means in the central station for interrogating the pads to receive from the pads signals identifying the first and second ones of the controls operated in the pads, second means in the central station for receiving from the pads signals identifying the first and second controls operated in the pads, third means in the central station for providing first signals constituting, for each of the pads, an address for the vehicle identified by the operation of the first controls in the pads and second signals identifying the operation of the second controls in the the pads, fourth means in the central station for transmitting the first and second signals for each of the pads to the vehicles, and fifth means in the central station for discontinuing the operation of the vehicles by the pads when none of the second controls in the pads is operated for a particular period of time to obtain the operation of the vehicles.

15. In a combination as set forth in claim 14, the second means in the central station receiving, from each of the pads, binary signals having first and second logical levels, each of the binary signals having a first binary level indicating the operation of one of the controls in the pads, and the third means providing for each of the pads the first binary signals identifying the address of the vehicle identified by the operation of the first controls in the pad and the second binary signals identifying the operation of the second controls in the pad.

16. In a combination as set forth in claim 14, the second means initially receiving in the central station from each of the pads signals identifying the operation of the first controls in the pad and receiving from the pad signals identifying the operation of the second controls in the pad for the period of time that the pad is operating the vehicle initially addressed by the first controls in the pads, and the third means providing in the central station the first signals constituting for each of the pads the address for the vehicle identified by the operation of the first controls in the pad when the second means receives from the pad, for the period of time that the pad is operating the vehicle, the signals identifying the operation of the second controls in the pad even when the second means does not receive the first signals identifying the operation of the first controls in the pad.

17. In a combination as set forth in claim 14 wherein the central station addresses one of the vehicles for operation by each of the pads in accordance with the number of operations of the first one of the controls in the pad within a particular period of time.

18. In a combination as set forth in claim 14, the first means including a read only memory for interrogating the pads to receive from each of the pads signals identifying the first and second controls operated in the pad, the read only memory also including the addresses for the vehicles, the third means including a random access memory for providing the first signals constituting, for each of the pads, the address for the vehicle identified by the operation of the first controls in the pad and for providing second signals identifying the operation of the second controls in the pad, the random access memory also providing a memory of the vehicle being operated at each instant by each of the pads.

19. In a combination as set forth in claim 18, the second means initially receiving, from each of the pads, the signals identifying the operation of the first and second controls in the pad and subsequently receiving from the pad, for the period of time that the pad is operating the vehicle controlled by the pad, the signals identifying the operation of the second controls in the pad, the third means providing the first signals constituting, for each of the pads, the address for the vehicle identified by the operation of the first controls in the pad when the third means receives from the pad, for the period of time that the pad is operating the vehicle, the signals identifying the operation of the second controls in the pad, the first means including a read only memory to provide for the interrogation of the pads to receive from the pads signals identifying the first and second controls operated in the pads, the read only memory also including the addresses for the vehicles, the third means including a random access memory for providing the first signals constituting, for each of the pads, the address for the vehicle identified by the operation of the first controls in the pad and the second signals identifying the operation of the second controls in the pad, the random access memory also providing a memory of the vehicle being operated at each instant by each of the pads.

20. In combination, a central station for use with a plurality of pads each having operable controls and for use with a plurality of vehicles each addressable in accordance with the operation of a first one of the controls in one of the pads and each operable to perform functions in the vehicle in accordance with the operation of second ones of the controls in the pad, first means in the central station for receiving from the pad signals indicating the operation of the first control to address the vehicle and the operation of the second controls in the pad to perform the functions in the vehicle, second means responsive in the central station to the signals indicating the addressing of the vehicles by the pads for producing first signals constituting addresses identifying the vehicles, and third means responsive in the central station, after the operation of the second means for each of the vehicles, to the operation of the second controls in the pad to produce second signals for obtaining in the vehicle the performance of the functions identified by the operation of the second controls in the pad even when the vehicle is not being addressed by the pad.

21. In a combination as set forth in claim 20, the second means producing the first signals in a binary code identified by signals individual to each of the vehicles, and the third means producing binary signals indicating the operation or the lack of operation of the second controls in the pads.

22. In a combination as set forth in claim 20, wires extending from the central station to provide communication with the pads, and an antenna for providing a wireless communication with the vehicles in accordance with the operation of the controls in the pads.

23. In a combination as set forth in claim 20, fourth means for discontinuing the operation of the third means for each of the vehicles when there is no operation, for a particular period of time, of the controls providing in the the associated pad for the operation of the vehicle.

24. In a combination as set forth in claim 20, the central station constituting a first central station, a second central station including first means, second means and third means respectively corresponding to the first means, the second means and the third means in the first central station, and fourth means for connecting the first and second central stations in a particular relationship to provide for the operation of the first, second and third means in one of the central stations under the control of the other one of the central stations.

25. In a combination as set forth in claim 20 wherein the first one of the controls in each of the pads is operative on an iterative basis within a particular period of time to select the motorized vehicle in accordance with the number of the iterative operations of the switch within the particular period of time.

26. In combination for use with first and second pluralities of pads each having a plurality of operable controls and for use with first and second pluralities of vehicles, each plurality of vehicles being associated with one of the first and second pluralities of pads, each of the vehicles in each of the pluralities being addressable in accordance with the operation of a first one of the controls in a selective one of the pads in the associated plurality and being operable to perform functions in accordance with the operation of second ones of the controls in the pad, a first central station responsive to the operation of the first and second ones of the controls in each of the pads in the first plurality to obtain the addressing of one of the vehicles in the first plurality and the performance of the functions in the vehicle, a second central station responsive to the operation of the first and second ones of the controls in each of the pads in the second plurality to obtain the addressing of one of the vehicles in the second plurality and the performance of the functions in the vehicle, and coupling means connected to the first and second central stations to have one of the first and second central stations act as a master and the other one of the first and second central stations act as a slave.

27. In a combination as set forth in claim 26, p1 the coupling means including a cable providing a grounded connection at one end and the grounded end being connected to the other one of the first and second central stations to obtain the operation of the other one of the first and second central stations as a slave station.

28. In a combination as set forth in claim 26, means in at least the master one of the first and second central stations for charging the vehicles, and means in at least the master one of the first and second central stations for discontinuing the charging of the vehicles after a particular period of time.

29. In a combination as set forth in claim 26, means in the master one of the first and second central stations for providing a memory of the vehicles being operated by the pads in the first and second pluralities at each instant, and means in the master one of the first and second central stations for skipping over the selection of the vehicles in the first and second pluralities at each instant when the vehicles are being operated by the pads in the first and second pluralities.

30. In combination in a central station for use with a plurality of pads each having a plurality of operable controls and for use with a plurality of vehicles each addressable in accordance with the operation of a first one of the controls in one of the pads and each operable to perform functions in the vehicle in accordance with the operation of second ones of the controls in the pad, first means in the central station for interrogating the pads to determine if the first one of the controls in the pads has been operated, second means responsive in the central station to the operation of the first one of the controls in each of the pads for sending first signals to the vehicle identified by the first one of the controls in the pad to obtain an activation of the vehicle, third means responsive in the central station to the activation of the vehicles for sending second signals to all of the vehicles in accordance with the operation of the second controls in the pads to obtain the performance in the vehicles of the functions represented by the operation of the second controls in the pads, and fourth means in the central station for providing for a discontinuance in the activation of each of the vehicles by the pad activating the vehicle when the pad fails to provide an operation of the vehicle for a particular period of time and when the vehicle is activated only by the pad.

31. In a combination in the central station as set forth in claim 30, fifth means in the second means in the central station for providing addresses identifying the vehicles in accordance with the operation of the first ones of the controls in pads and for producing the first signals in accordance with the identifying addresses, and sixth means in the third means in the central station for sending the second signals for the vehicles concurrently with the sending of the first signals for the vehicles.

32. In a combination in the central station as set forth in claim 30, the sixth means being operable to send the second signals for the vehicles concurrently with the sending of the first signals for the vehicles without receiving from the pads the signals identifying the vehicles.

33. In a combination as set forth in claim 30, seventh means for discontinuing the operation of the fifth means for each of the vehicles when there is no operation for a particular period of time of any of the controls in the pad controlling the operation of the vehicle.

34. In a combination as set forth in claim 30 wherein the first one of the controls in each of the pads is operative on an iterative basis within a particular period of time to select the motorized vehicle in accordance with the number of the iterative operations of the switch within the particular period of time.

35. In combination, a plurality of motorized vehicles each having a plurality of motors for moving the vehicles forwardly and rearwardly and for turning the vehicle to the right and left and each having an operable member, a plurality of pads each having a plurality of controls for addressing any one of the motorized vehicles, for operating the motors in the vehicle to move the vehicle forwardly and rearwardly and to turn the vehicle to the right and left and for operating the operable member in the vehicle, a central station for interrogating the pads to determine the operation of the controls in the pads for obtaining an operation of the motors in the vehicles to move the vehicles forwardly and rearwardly and to turn the vehicles to the right and left and for operating the operable member in the vehicles, first means responsive in the central station to the operation of the controls in the pads for producing first signals providing an address for the vehicles selected by the pads and second signals identifying to the vehicles the controls operated in the pads, second means in the central station for sending the first and second signals to all of the vehicles, and third means in each of the vehicles for providing for a release of the vehicle by the pad addressing the vehicle when the controls providing in the pad for the operation of the motors and the operable members in the vehicle are not operated for a particular period of time and when the vehicle is addressed only by the pad.

36. In a combination as set forth in claim 35, fourth means in the vehicles for receiving the signals transmitted from the central station for the pads and for decoding the signals in accordance with the addresses of the vehicles and for operating the motors in the vehicles in accordance with the operation of the controls in the pads.

37. In a combination as set forth in claim 35, fourth means in the vehicles for releasing the vehicles from the pads when the pads address different ones of the vehicles than the vehicles previously addressed by the pads.

38. In a combination as set forth in claim 35, a plurality of wires extending from each of the pads in the plurality to the central station, the central station having an antenna for sending the signals on a wireless basis in the first and second pluralities to the vehicles in the plurality, and an antenna on each of the vehicles in the plurality for receiving the signals transmitted in the first and second pluralities from the central station to the vehicles in the plurality.

39. In a combination as set forth in claim 35, the central station including means for providing the first and second signals for transmission in a binary coded form to the vehicles, and each of the vehicles including means for decoding the first and second signals transmitted in the binary coded form and including means for operating the motors in the vehicles and the operable member in accordance with the decoded signals.

40. In a method at a central station for controlling the operation of a plurality of vehicles in accordance with the addressing of the vehicles by pads in a plurality and in accordance with the operation in the pads of controls to obtain the performance of functions in the vehicles, including the steps of:

interrogating the pads to determine from the pads the addressing of the vehicles and the functions to be performed in the addressed vehicles, receiving from the pads indications of the vehicles addressed by the pads and indications of the functions to be performed in the addressed vehicles, providing first signals indicating the address of each of the vehicles and second signals indicating the functions to be performed in the vehicle, providing packets with the first and second signals, after the addressing of the vehicles by the pads, even when the pads provide only the second indications, and transmitting the packets with the first and second signals to all of the vehicles to obtain a processing by the vehicles of the packets of signals in which the addresses represented by the first signals for the vehicles corresponds to the addresses of the vehicles.

41. In a method as set forth in claim 40, including the steps of:

providing a memory of the addressing of the vehicles by the pads and the addresses of the vehicles, and thereafter providing the signals indicating in the memory the addresses of the vehicles addressed by the pads when the central station receives from the pads the indications of the functions to be performed by the vehicles without receiving the indications of the vehicles addressed by the pads, and transmitting the packets with the first and second signals to all of the vehicles.

42. In a method as set forth in claim 40 where the central station interrogates the pads through wires connected between the central station and the pads and receives signals from the pads through the wires and provides power to the pads through the wires wherein the central station transmits the packets of signals to the vehicles on a wireless basis.

43. In a method as set forth in claim 40, including the steps of:

there being a plurality of accessories for addressing by the pads, receiving from the pads indications of the addressing of the accessories by the pads, and transmitting signals to the accessories in accordance with the indications from the pads of the addressing of the accessories thereby to obtain the operation of the accessories.

44. In a method as set forth in claim 43 wherein the central station interrogates the individual ones of the pads on the cyclic basis through wires connected between the central station and the pads and receives signals from the pads through wires connected between the central station and the pads and wherein the central station transmits the signals to the individual ones of the stationary accessories through wires connected between the central station and the individual ones of the stationary accessories and wherein the central station transmits the signals to the individual ones of the vehicles in the plurality on a wireless basis.

45. In a method as set forth in claim 40, including the step of:

releasing each of the vehicles to provide for the addressing of the vehicle by any one of the pads when the central station fails to receive for a particular period of time signals from the pad addressing the vehicle upon the interrogation of the pad by the central station, and preventing each of the vehicles from being addressed by more than one of the pads at any time.

46. In a method as set forth in claim 45, including the steps of:

there being a plurality of accessories for addressing by the pads, receiving from the pads indications of the addressing of the accessories by the pads, and transmitting signals to the accessories in accordance with the indications from the pads of the addressing of the accessories thereby to obtain the operation of the accessories and wherein the central station interrogates the pads through wires connected between the central station and the pads and receives signals from the pads through wires connected between the central station and the pads and wherein the central station transmits the signals to the accessories through wires connected between the central station and the accessories and wherein the central station transmits the signals to the vehicles on a wireless basis.

47. In a method as set forth in claim 45, releasing each of the vehicles to provide for an addressing of the vehicle by any of the pads when the pad addressing the vehicle addresses another one of the vehicles.

48. In a method for providing a co-operation between one of a plurality of pads and a central station to address any one of a plurality of vehicles and to obtain the operation of functions in the vehicle, including the steps of:

providing in the pad controls operable to provide for the addressing of the vehicle and to provide for the performance of the functions in the vehicle, receiving in the pad from the central station signals interrogating the pad to determine the pattern of operation of the controls in the pad, sending to the central station from the pad signals, upon the reception at the pad of the interrogating signals from the central stations in a pattern to indicate the addressing of the vehicle and the performance of the functions in the vehicle, and providing in the central station for the release of the vehicle by the central station when the pad fails to provide for the sending to the central station for a particular period of time of signals indicating the performance of the functions in the vehicle, and when the pad is the only one of the pads providing for the control of the performance of the functions in the vehicle.

49. In a method as set forth in claim 48, including the steps of:

there being a plurality of accessories, providing in the pad at least one additional control operable to obtain the addressing of one of the accessories, and sending to the central station signals indicating the operation in the pad of at least one additional control upon the reception by the pad from the central station of the signals interrogating the pad.

50. In combination for providing first signals indicating one of a plurality of vehicles to be activated and indicating functions to be performed in the vehicle, one of a plurality of pads, a plurality of switches in the pad, at least a first one of the switches being operable to provide for the addressing of the vehicle, second ones of the switches being operable to provide for the performance of the functions in the vehicle, a central station, first means in the central station for activating the pads to obtain an indication of the operation of the switches in the pads, and second means responsive in the central station to the activation of the pads for sending to all of the vehicles the first signals indicating the operation of first and second ones of the switches in the pad, a read only memory in the central station for storing indications representing a particular period of time, a random accessory memory in the central station for storing indications of a particular period of time since the last operation of the second ones of the switches in the pad, means responsive in the central station to the indications of time in the read only memory and the random access memory for releasing the vehicle from control by the pad when the period of time indicated in the random access memory is at least equal to the period of time indicated in the read only memory, and means disposed in the central station and including the read only memory and the random access memory for providing a re-charging of the vehicle for a particular period of time.

51. In a method of selectively controlling the operation of toy vehicles, including the steps of:

providing a plurality of pads each having controls operable to address any one of the vehicles and to select functions to be performed in the vehicle, operating controls in the pads to obtain the addressing by each pad of one of the vehicles and the selection of the functions to be performed in the vehicle, providing a central station, providing for an interrogation of the pads by the central station to determine the addressing by each pad of one of the vehicles, providing for the transmission by each of the pads to the central station, upon the interrogation of the pad by the central station, of signals indicating the vehicle addressed by the pad and signals indicating the functions to be performed by the vehicle, providing in the central station, for each of the vehicles, an address indicating the vehicle selected by the pad upon the interrogation of the pad even when only the functions to be performed in the vehicle are indicated thereafter in the pad, and providing for the transmission by the central station to all of the vehicles of signals indicating the address of the vehicle addressed by the pad and indicating the functions to be performed in the vehicle.

52. In a method as set forth in claim 51, including the steps of:

receiving at each of the vehicles the signals transmitted from the central station, and decoding at each of the vehicles the signals indicating the functions to be performed by the vehicle when the received signals indicate the address of the vehicle.

53. In a method as set forth in claim 51, including the steps of:

providing in packets at the central station the signals indicating the address of the vehicle and the functions to be performed in the vehicle, and responding at the vehicle to the packets of signals indicating the address of the vehicle to perform in the vehicle the functions indicated by the signals in the packets.

54. In a method as set forth in claim 51, including the steps of:

providing in packets at the central station the signals indicating the address of the vehicles and the functions to be performed in the vehicles, decoding at each of the vehicles the packets of signals indicating the functions to be performed by the vehicle when the signals received by the vehicle indicate the address of the vehicle, performing in each of the vehicles the functions indicated in the decoded packets, providing a plurality of accessories each operative to perform a function, operating one of the controls in each of the pads to address one of the accessories, providing for the transmission by each of the pads, upon the interrogation of the pad by the central station, of signals indicating the operation of the control in the pad to address the accessory, providing for the transmission by the central station to the accessory of signals for obtaining the operation of the accessory, providing for the transmission of signals between the pads and the central station through wires and providing for the transmission of signals from the central station to the accessories through wires and providing for the transmission of signals from the central station to the vehicles on a wireless basis, and providing for the release of the vehicle from control by the central station when the vehicle fails to receive signals from the central station with the address of the vehicle for a particular period of time from the pad addressing the vehicle and when the pad is the only pad addressing the vehicle.

55. In a method as set forth in claim 51, including the steps of:

providing a plurality of accessories each operative to perform a function, operating one of the controls in each of the pads to address one of the accessories, providing for the transmission by each of the pads to the central station, upon the interrogation of the pad by the central station, of signals indicating the operation of the control in the pad to address one of the accessories, and providing for the transmission by the central station to each of the accessories of signals for obtaining the operation of the accessory.

56. In a method as set forth in claim 55, including the step of:

providing for the transmission of signals between the pads and the central station through wires and providing for the transmission of signals from the central station to the stationary accessories through wires and providing for the transmission of signals from the central station to the vehicles on a wireless basis.

57. In combination, a plurality of motorized vehicles each having first controls to provide a movement of the vehicle in different directions in accordance with the operation of the first controls and each having members to perform functions and each having second controls to obtain the performance of the functions, a plurality of pads each having a plurality of switches controlling the addressing of any one of the motorized vehicles and controlling the energizing of the first and second controls in the addressed motorized vehicle, and a central station responsive to the operation of the switches in each of the pads for providing for an operation of the first and second controls in the vehicle addressed by the pad, the central station being operative to interrogate the pads to determine the operation of the switches in the pads, the central station including means for retaining a communication previously established between the pad and the vehicle when there is a communication between the pad and the vehicle, within a particular period of time after the last previous communication between the the pad and the vehicle, during the interrogation of the pad by the central station and for discontinuing the previously established communication between the pad and the vehicles when there is not a communication between the pad and the vehicle within the particular period of time and when the pad is the only one of the pads addressing the vehicle.

58. In a combination as set forth in claim 57, the central station being connected by wires to the pads in the plurality and communicating by wireless to the vehicles in the plurality.

59. In a combination as set forth in claim 57, the central station providing common carrier signals for communication with the vehicles and providing on such carrier signals modulations providing addresses identifying each of the vehicles and identifying the operation of the first and second switches in the pad communicating with the vehicle.

60. In a combination as set forth in claim 57, the central station being connected by wires to the pads and the central station including an antenna for transmitting on a wireless basis to the vehicles the signals representing the addresses of the vehicle and the operation of the controls at the pads.

61. In a method at a central station for controlling the operation of a plurality of vehicles in accordance with the addressing of the vehicles by a plurality of pads and in accordance with the operation in the pads of controls to obtain the performance of functions in the vehicles, including the steps of:

receiving from the pads first signals indicating the addressing of the vehicles and second signals indicating the functions to be performed in the addressed vehicles, producing first patterns of signals indicating the addresses of the vehicles addressed by the pads in accordance with the receipt of the first signals from the pads, producing for each of the vehicles a second pattern of signals indicating the functions to be performed in the vehicles, combining the first and second patterns of signals for each of the vehicles to produce packets of signals, transmitting the packets of the signals in the first and second patterns for each of the vehicles to obtain the reception of the packets in the vehicles in accordance with the addresses represented by the first patterns of the signals in the packets and to obtain the performance of the functions in the vehicles in accordance with the second patterns of the signals in the packets, and maintaining the addressing of each of the vehicles by the pad addressing the vehicle as long as the central station continues to receive from the pad the second pattern of signals, within a particular period of time after the previous reception of the second pattern of signals by the central station, indicating the functions to be performed in the vehicle.

62. In a method at a central station for controlling the operation of a plurality of vehicles in accordance with the addressing of the vehicles by a plurality of pads and in accordance with the operation in the pads of controls to obtain the performance of functions in the vehicles, including the steps of:

receiving from the pads first signals indicating the addressing of the vehicles and second signals indicating the functions to be performed in the vehicles, producing first patterns of signals indicating the addresses of the vehicles addressed by the pads in accordance with the receipt of the first signals from the pads, producing for each of the vehicles a second pattern of signals indicating the functions to be performed in the vehicle, combining the first and second patterns of signals for each of the vehicles to produce packets of the signals, and transmitting the packets of the signals in the first and second patterns for each of the vehicles to obtain the reception of the packets in the vehicles in accordance with the addresses represented by the first patterns of the signals in the packets and to obtain the performance of the functions in the vehicles in accordance with the second patterns of the signals in the packets, the central station constituting a first central station and the pads in the plurality constituting a first plurality of pads and the vehicles in the plurality constituting a first plurality of vehicles, providing a second central station which operates in the same manner as the first central station and which responds to the signals from pads in a second plurality to control the addressing and operation of vehicles in a second plurality, and making the operation of the second central station a slave to the operation of the first central station.

63. In a method at a central station for controlling the operation of a plurality of vehicles in accordance with the addressing of the vehicles by a plurality of pads and in accordance with the operation in the pads of controls to obtain the performance of functions in the vehicles, including the steps of:

receiving from the pads first signals indicating the addressing of the vehicles and second signals indicating the functions to be performed in the addressed vehicles, producing first patterns of signals indicating the addresses of the vehicles addressed by the pads in accordance with the receipt of the first signals from the pads, producing for each of the vehicles a second pattern of signals indicating the functions to be performed in the vehicles, combining the first and second patterns of signals for each of the vehicles to produce packets of the signals, and transmitting the packets of the signals in the first and second patterns for each of the vehicles to obtain the reception of the packets in the vehicles in accordance with the addresses represented by the first patterns of the signals in the packets and to obtain the performance of the functions in the vehicles in accordance with the second patterns of the signals in the packets, providing a memory, storing in the memory the addressing of the vehicles by the pads, and eliminating from the memory the addressing of the vehicles by the pads when the central station fails to receive the second patterns of signals from the pads for a particular period of time in the vehicles, and maintaining the addressing of the vehicles by the pads as long as the central station continues to receive the second patterns of signals from the pads within a particular period of time after the previous reception by the central station of the second patterns of signals from the pads.

64. In a method as set forth in claim 63, including the steps of:

the central station constituting a first central station and the pads in the plurality constituting a first plurality and the vehicles in the plurality constituting a first plurality, providing a second central station which operates in the same manner as the first central station and which responds to the signals from pads in a second plurality to control the addressing and operation of vehicles in a second plurality, and making the operation of the second central station a slave to the operation of the first central station.

65. In combination, a plurality of motorized vehicles each having first controls to provide a movement of the vehicle in accordance with the operation of the first controls, each of the motorized vehicles having an address, a plurality of pads each having switches controlling the addressing of any one of the motorized vehicles and controlling the movements of the addressed vehicle, first means responsive to the operations of the switches in the pads for providing for the addressing of the motorized vehicles and for providing for movements of the addressed motorized vehicles, the first means being displaced from the pads and the vehicles, second means in the first means for interrogating the pads in the plurality to determine the operation of the switches in the pads and for receiving the signals from the interrogated pads and for producing signals, in accordance with the operation of the switches, representing the addresses of the vehicles selected by the pads and representing movements of the vehicles, third means disposed at the motorized vehicles and responsive to the signals indicating the addresses produced by the second means for energizing the vehicles represented by the addresses and responsive to the signals indicating the operation of the switches in the pads for producing the movements of the vehicles, and fourth means in the first means for providing for the movements of the vehicles after the addressing of the vehicles by the pads even during the time that the pads are not addressing the vehicles but are being operated to provide for movements of the vehicles.

66. In combination, a plurality of motorized vehicles each having controls to provide a movement of the vehicle in accordance with the operation of the controls, a plurality of pads each having a plurality of switches operable to control the addressing of any one of the motorized vehicles and the operation of the controls in the addressed vehicle, and means in each of the vehicles for providing for the addressing of the vehicle by any one of the pads when the switches in the pad providing for the addressing of the vehicle and for the operation of the controls in the vehicle have not been operated for a particular period of time and when the pad is the only pad addressing the vehicle.

67. In a combination as set forth in claim 66, each of the pads having an illuminable light on the pad, means on each of the pads for illuminating the light on the pad when the switches in the pad are operated within the particular period of time, each of the vehicles having an illuminable light disposed on the vehicle and identifying the vehicle, and means on each of the vehicles for illuminating the light on the vehicle when the controls on the vehicle are being operated in accordance with the operation of the switches in one of the pads.

68. In a combination as set forth in claim 66 wherein one of the switches in the pad addressing the vehicle is closed a particular number of times on an iterative basis within a particular period of time to address the vehicle.

69. In a combination as set forth in claim 66 wherein the addressing means in each of the vehicles includes a microcomputer in the vehicle for indicating the period of time that the controls in the vehicle have not been operated and for providing for a release of the vehicle for an addressing of the vehicle by any one of the pads when the vehicle has not been operated by the pad for the particular period of time and when the pad is the only pad addressing the vehicle.

70. In combination as set forth in claim 69, means for releasing the vehicle from control by the pad addressing the vehicle, and for providing for the addressing of the vehicle by any of the pads, when the pad addresses another one of the vehicles.

71. In a combination as set forth in claim 66, each of the vehicles having an operable member and having additional controls to provide an operation of the member, and each of the pads having additional switches operable to control the operation of the additional controls in the vehicle.

72. In a combination as recited in claim 71 wherein the addressing means in each of the vehicles includes a microcomputer in the vehicle for indicating the period of time that the controls in the vehicle have not been operated and for providing for a release of the vehicle for operation by any one of the pads when the switches in the pad providing for the selection of the vehicle have not been operated for the particular period of time and wherein each of the pads has an illuminable light on the pad and wherein means are provided on each of the pads for illuminating the light on the pad when the switches in the pad are operated within the particular period of time and wherein each of the vehicles has an illuminable light disposed on the vehicle and individually identifying the vehicle and wherein means are provided on each of the vehicles for illuminating the light on the vehicle during the time that the controls on the vehicle are being operated in accordance with the operation of the switches in one of the pads and for the particular period of time after the time that the controls of the vehicle are being operated in accordance with the switches in any one of the pads.

73. In a combination as set forth in claim 72 wherein the operable member is movable independently of any movements of the vehicle and the additional switches in each of the pads are operative to provide a movement of the member in the vehicle independently of any movement of the vehicle.

74. In combination, a plurality of motorized vehicles each having controls to provide a movement of the vehicle in accordance with the operation of the controls, a plurality of pads each having a plurality of switches operable to address any one of the motorized vehicles and to obtain the operation of the controls in the addressed vehicle to provide a movement of the addressed motorized vehicle, each of the vehicles being illuminable to identify the vehicle, means on each of the vehicles for illuminating the vehicle to identify the vehicle when the controls on the vehicle are being operated in accordance with the operation of the switches in one of the pads, means in each of the vehicles for maintaining the operation of the vehicle by the pad and for providing the illumination of the vehicle to identify the vehicle after the pad has addressed the vehicle for operation, and means in each of the vehicles for providing for the addressing of the vehicle by any one of the pads, and for discontinuing the illumination of the vehicle, when the pad addressing the vehicle fails to operate any of the controls in the vehicle for a particular period of time after the addressing of the vehicle by the pad and when the pad is the only pad addressing the vehicle.

75. In a combination as set forth in claim 74, each of the vehicles having an operable member and having additional controls to provide an operation of the operable member, and each of the pads having additional switches operable to control the operation of the additional controls in the vehicle to provide an operation of the member in the vehicle independently of any movement of the vehicle.

76. In a combination as set forth in claim 74, wherein one of the switches in each of the pads is sequentially operative within a particular period of time to address the motorized vehicle in accordance with the number of sequential operations of the switch within the particular period of time.

77. In a combination as set forth in claim 74, wherein the addressing means in each of the vehicles includes a microcomputer in the vehicle for indicating the period of time that the vehicle has not been operated by the pad addressing the vehicle and for providing for a release of the vehicle for operation by any one of the pads when the vehicle has not been operated for the particular period of time by the pad addressing the vehicle.

78. In a combination as set forth in claim 65, wherein one of the switches in each of the pads is sequentially operative within a particular period of time to address the motorized vehicle in accordance with the number of the sequential operations of the switch within the particular period of time.

79. In a combination as set forth in claim 65, the second means being responsive to the signals from the pads to produce signals at a common carrier frequency and to modulate the signals at the common carrier frequency in accordance with the operation of the switches in the pads, and the third means being disposed at the motorized vehicles and being responsive to the signals at the common carrier frequency for addressing the motorized vehicles and producing the movements of the addressed motorized vehicles.

80. In combination, a plurality of motorized vehicles each having controls to provide a movement of the vehicle in accordance with the operation of the controls, a plurality of pads each having switches for controlling the addressing of any one of the motorized vehicles and for controlling the energizing of the controls in the addressed motorized vehicle, a central station responsive to the operation of the switches in each of the pads for providing for an operation of the controls in the vehicle, the central station including means for interrogating the pads in the plurality to determine if there is an operation of the switches in the pads and including means for communicating the operation of the switches in the pads to the vehicles to obtain the operation of the vehicles in accordance with the operation of the switches, and means in the central station for releasing each of the vehicles from control by the pad addressing the vehicles when the switches providing in the pad for the operation of the controls in the vehicle are not operated for a particular period of time to obtain the operation of the vehicle and when the vehicle is being controlled only by the pad addressing the vehicle.

81. In a combination as set forth in claim 80, the central station including means for retaining a communication previously established between the pads and the vehicles when there is a selective operation, within a particular period of time after the last previous communication between the pads and the vehicles, of the switches in the pads and for discontinuing the previously established communication when there is not a selective operation of the switches in the pads within the particular period of time.

82. In a combination as recited in claim 80, the central station providing common carrier signals for communication with the vehicles and providing on the carrier signals modulations providing addresses identifying the vehicles and identifying the operation of the switches in the pads communicating with the addressed vehicles, the central station being connected by wires to the pads to provide power to the pads and to communicate with the pads and the central station communicating by wireless with the vehicles.

83. In a combination as set forth in claim 80, means in the central station for releasing the vehicles from control by the pads when the pads address vehicles other than the vehicles previously addressed by the pads.

84. In combination for use in a vehicle with control means having properties of providing packets of signals, each packet including a binary address and binary signals identifying controls, wheels on the vehicle for moving the vehicle, motive means operable for propelling the vehicle forwardly and rearwardly and for turning the vehicle in opposite directions, controls energizable in the vehicle to provide movements of the vehicle by the motive means forwardly and rearwardly and to provide turnings of the vehicle in the opposite directions, first means in the vehicle for receiving the packets of signals transmitted from the control means, the packets of signals including a binary address identifying the vehicle and binary signals indicating the energizing of the controls in the vehicle, second means in the vehicle for decoding the binary signals to recover the packets with the address of the vehicle, third means in the vehicle for decoding, in the packets with the address of the vehicle, the binary signals indicating the energizing of the controls, fourth means in the vehicle for energizing the motive means in accordance with the decoding by the second means of the binary signals indicating the energizing of the controls, fifth means operatively coupled in the vehicle to the motive means and responsive to the decoding of the binary signals by the third means for providing an initial movement of the vehicle at a first particular speed, and sixth means responsive in the vehicle to the continued movement of the vehicle at the first particular speed for a particular period of time for changing the speed of movement of the vehicle to a second particular speed.

85. In a combination as set forth in claim 84, means disposed on the vehicle for providing an indication that the vehicle has been energized by the packets of signals from the control means.

86. In combination for use with control means having properties of providing packets of signals, each packet including a binary address and binary signals identifying the energizing of controls, a toy vehicle displaced from the control means, wheels on the vehicle for moving the vehicle, motive means selectively operable in the vehicle for propelling the vehicle forwardly and rearwardly and for turning the vehicle in opposite directions, an operable member disposed on the vehicle, controls operable in the vehicle to provide movements of the vehicle by the motive means forwardly and rearwardly and to provide turnings of the vehicle in the opposite horizontal directions, first means in the vehicle for receiving the packets of signals transmitted from the control means, the packets of signals including a binary address identifying the vehicle and binary signals indicating the energizing of the controls in the vehicle, second means in the vehicle for decoding the binary signals in the packets to recover the packets with the binary address of the vehicle, third means in the vehicle for decoding, in the packets with the binary address of the vehicle, the binary signals indicating the energizing of the controls, and fourth means in the vehicle for energizing the motive means in accordance with the decoding by the third means of the binary signals indicating the energizing of the controls, fifth means in the vehicle for operating the operable member, sixth means operatively coupled in the vehicle to the motive means and responsive to the operation of the fourth means for providing a movement of the vehicle, seventh means responsive in the vehicle to the failure of the vehicle to receive from the control means for a particular period of time the packets of signals with the binary address of the vehicle for providing for a release of the vehicle from operation by the control means, and eighth means disposed on the vehicle for providing an illumination identifying the vehicle and indicating that the vehicle has been energized by the packets of signals from the control means.

87. In a combination as set forth in claim 86, the operable member being movable in opposite directions, the fifth means being operative to move the operable member in the opposite directions.

88. In combination, a central station for use with a plurality of pads each having a plurality of operable controls and for use with a plurality of vehicles each addressable in accordance with the operation of first ones of the controls in the pads, first means in the central station for receiving from the pads signals indicating the addressing of the vehicles by the pads and the operation of the controls in the pads, second means responsive in the central station to the signals indicating the addressing of the vehicles by the pads for producing addresses identifying the addressed vehicles, third means responsive in the central station to the production by the second means of the addresses identifying the vehicles for transmitting signals representing such addresses and signals indicating the operation of the controls in the pads, the central station constituting a first central station, a second central station including first means, second means and third means in the second central station respectively corresponding to the first, second and third means in the first central station, and fourth means for connecting the first and second central stations in a particular relationship to provide for the operation of the first, second and third means in one of the central stations under the control of the other one of the central stations.

89. In combination, a plurality of motorized vehicles each having motors for moving the vehicle forwardly and rearwardly and for turning the vehicle to the right and left, a plurality of pads each having controls for selecting one of the motorized vehicles and for operating the motors in the vehicle to move the vehicle forwardly and rearwardly and to turn the vehicle to the right and left, a central station for interrogating the pads in the plurality to determine the operation of the controls in the pads for obtaining an operation of the motors in the vehicles to move the vehicles forwardly and rearwardly and to turn the vehicles to the right and left, first means responsive in the central station to the operation of the controls in the pads for producing first signals providing an address for the vehicles selected by the pads and second signals identifying to the addressed vehicles the controls operated in the pads, second means in the central station for sending the first and second signals to the vehicles, and third means in the vehicles for providing for a release of each of the addressed vehicles from the pad addressing the vehicle and for providing for the addressing of the vehicle by any of the pads when the vehicle is not operated by the pad for a particular period of time and when the pad is the only pad addressing the vehicle.

90. In a combination as set forth in claim 89, the central station including means for providing the first and second signals for transmission in a binary coded form to the vehicles, and the fourth means in the addressed vehicles being operable to decode the first and second signals transmitted in the binary coded form and to operate the motors in the addressed vehicles in accordance with the decoded signals.

91. In a combination as set forth in claim 89, fourth means in the vehicles for receiving the first and second signals from the central station and for decoding such signals in accordance with the addresses of the vehicles and for operating the motors in the addressed vehicles in accordance with the operation of the controls providing in the pads for the operation of the motors in the addressed vehicles.

92. In a combination as set forth in claim 91, a plurality of wires extending from each of the pads to the central station to provide power to the pads from the central station and to provide a communication between the pads and the central station, the central station having an antenna for sending the signals on a wireless basis to the vehicles, and an antenna on each of the vehicles for receiving the signals transmitted from the central station to the vehicles.

93. In combination for use with a central station for transmitting signals representing an address and representing functions to be performed and for use with a plurality of pads each having controls operable to provide the address and to indicate the functions to be performed, a movable vehicle having the address, first means in the vehicle for receiving the signals transmitted from the central station, second means responsive in the vehicle to the received signals for passing the signals with the address of the vehicle, third means responsive in the vehicle to the signals passed by the second means with the address of the vehicle for performing the functions indicated by the received signals, and fourth means responsive in the vehicle to a failure of the vehicle to receive signals from the central station with the address of the vehicle for a particular period of time for releasing the vehicle from the performance of functions indicated by the signals from the pad and for providing for the addressing thereafter of the vehicle by any one of the pads, the pad being the only pad addressing the vehicle.

94. In a combination as set forth in claim 93, an illuminable member disposed on the vehicle and identifying the vehicle, and means in the vehicle for providing an illumination of the member during the reception by the vehicle of the signals with the address of the vehicle from the pad and for providing for an extinguishing of the illumination by the illuminable member when the vehicle fails to receive signals from the central station with the address of the vehicle for the particular period of time.

95. In a combination as set forth in claim 94, a read only memory in the vehicle for storing the address of the vehicle, a random access memory in the vehicle for storing the address of the signals received from the central station, and means in the vehicle for comparing the addresses in the read only memory and the random access memory for providing for the passage by the second means in the vehicle only of the signals from the central station with the address of the vehicle.

96. In a combination as set forth in claim 94, a read only memory in the vehicle for storing the particular period of time, a random access memory in the vehicle for storing the period of time since the last reception by the vehicle of signals from the central station with the address of the vehicle, and means for comparing the indications of time in the read only memory and the random access memory to provide for the extinguishing of the illumination by the illuminable member in the vehicle when the vehicle fails to receive signals from the central station with the address of the vehicle for the particular period of time.

97. In a combination as set forth in claim 96, the read only memory in the vehicle storing the address of the vehicle, the random access memory in the vehicle storing the address of the signals received from the central station, and means in the vehicle for comparing the addresses in the read only memory and the random access memory for providing for the passage by the second means only of the signals from the central station with the address of the vehicle.

98. In combination for use with control means having properties of providing packets of signals from a plurality of controlling members, each packet including binary signals providing a binary address and binary signals identifying different controls, a toy vehicle displaced from the control means, wheels on the vehicle for moving the vehicle, motive means disposed on the vehicle and operable for moving the vehicle forwardly and rearwardly and for turning the vehicle in opposite directions, an operable member disposed on the vehicle, first means disposed on the vehicle for operating the operable member, first controls operable in the vehicle to provide controlled movements of the vehicle by the motive means forwardly and rearwardly and to provide controlled turnings of the vehicle by the motive means in the opposite directions, second controls operable in the vehicle to provide controlled operations of the operable member, second means in the vehicle for receiving the packets of signals transmitted from the control means, the packets of signals including a binary address identifying the vehicle and binary signals indicating the operation of the first and second controls in the vehicle, third means in the vehicle for decoding the binary signals to recover the packets with the address of the vehicle, fourth means in the vehicle for decoding, in the packets with the address of the vehicle, the binary signals indicating the operation of the first and second controls in the vehicle, and fifth means in the vehicle for operating the motive means and the first means in accordance with the decoding of the binary signals by the fourth means, sixth means in the vehicle for providing a memory indicating the period of time since the last address of the vehicle by the control means, and seventh means operatively coupled to the fifth means and the sixth means for de-coupling the vehicle from addressing by the control means when the sixth means indicates that the vehicle has not been addressed by the control means for a particular period of time, such de-coupling thereafter continuing until the control means provides the packets from any one of the controlling members with the binary signals providing the binary address of the vehicle.

99. In combination for use with control means having properties of providing packets of signals, each packet including binary signals providing a binary address and binary signals identifying different controls, a toy vehicle displaced from the control means, wheels on the vehicle for moving the vehicle, motive means disposed on the vehicle and operable for moving the vehicle forwardly and rearwardly and for turning the vehicle in opposite directions, an operable member disposed on the vehicle, first means disposed on the vehicle for operating the operable member, first controls operable in the vehicle to provide controlled movements of the vehicle by the motive means forwardly and rearwardly and to provide controlled turnings of the vehicle by the motive means in the opposite directions, second controls operable in the vehicle to provide controlled operations of the operable member, second means in the vehicle for receiving the packets of signals transmitted from the control means, the packets of signals including a binary address identifying the vehicle and binary signals indicating the operation of the first and second controls in the vehicle, third means in the vehicle for decoding the binary signals to recover the packets with the address of the vehicle, fourth means in the vehicle for decoding, in the packets with the address of the vehicle, the binary signals indicating the operation of the first and second controls in the vehicle, and fifth means in the vehicle for operating the motive means and the first means in accordance with the decoding of the binary signals by the fourth means, sixth means in the vehicle for providing a memory indicating the period of time since the last address of the vehicle by the control means, seventh means operatively coupled to the fifth means and the sixth means for releasing the vehicle from control by the control means when the sixth means indicates that the vehicle has not been addressed by the control means for a particular period of time and means disposed on the vehicle for providing a visual illumination identifying the vehicle and indicating that the vehicle has been addressed by the packets from the control means.

100. In a combination as set forth in claim 99, means in the vehicle for providing for the addressing of the vehicle by the control means in any one of the pads when the vehicle fails to receive for a particular period of time packets of signals from the control means in the pad addressing the vehicle.

101. In a combination as set forth in claim 99, means in the vehicle for extinguishing the illumination identifying the vehicle when the vehicle has not received the packets of signals from the control means with the address of the vehicle for a particular period of time.

102. In combination in a vehicle for use with control means having properties of providing packets of signals from a plurality of controlling members, each packet including first signals providing a binary address of the vehicle different from binary addresses for other vehicles and second signals providing binary indications of controls to be provided in the vehicle, the vehicle being usable with transportable elements, first means in the vehicle for decoding the first signals in the packets from the control means with the binary address of the vehicle, second means responsive in the vehicle to first ones of the second signals in the packets from the control means with the address of the vehicle for moving the vehicle in forward and reverse directions and for turning the vehicle, third means in the vehicle for receiving, holding and releasing the transportable elements, fourth means responsive to second ones of the second signals in the packets with the address of the vehicle for operating the third means in receiving, holding and releasing the transportable elements, and fifth means in the vehicle for de-coupling the vehicle from addressing by the control means upon a failure of the control means to address the vehicle for a particular period of time and until the control means thereafter provides the first signals with the binary address of the vehicle from any of the controlling members.

103. In a combination as set forth in claim 102, sixth means including a plurality of switches manually settable in the vehicle to vary the binary address of the vehicle.

104. In a combination as set forth in claim 103, an antenna for receiving the first and second signals from m the control means.

105. In combination in a vehicle for use with control means having properties of providing packets of signals, each packet including first signals providing a binary address of the vehicle different from binary addresses for other vehicles and second signals providing binary indications of controls to be provided in the vehicle, the vehicle being usable with transportable elements, first means in the vehicle for decoding the first signals in the packets from the control means with the binary address of the vehicle, second means responsive in the vehicle to first ones of the second signals in the packets from the control means with the address of the vehicle for moving the vehicle in forward and reverse directions and for turning the vehicle, third means in the vehicle for receiving holding and releasing the transportable elements, fourth means responsive to second ones of the second signals in the packets with the address of the vehicle for operating the third means in receiving, holding and releasing the transportable elements, and fifth means in the vehicle for releasing the vehicle from addressing by the control means upon a failure of the control means to address the vehicle for a particular period of time sixth means in the vehicle for providing a visual illumination identifying the vehicle and indicating the addressing of the vehicle during the period of time that the vehicle is addressed.

106. In combination in a vehicle for use with control means having properties of providing packets of signals, each packet including first signals providing a binary address of the vehicle different from binary addresses for other vehicles and second signals providing binary indications of controls to be provided in the vehicle, the vehicle being usable with transportable elements, first means in the vehicle for decoding the first signals in the packets from the control means with the binary address of the vehicle, second means responsive in the vehicle to first ones of the second signals in the packets from the control means with the address of the vehicle for moving the vehicle in forward and reverse directions and for turning the vehicle, third means in the vehicle for receiving, holding and releasing the transportable elements, fourth means responsive to second ones of the second signals in the packets with the address of the vehicle for operating the third means in receiving, holding and releasing the transportable elements, and fifth means in the vehicle for releasing the vehicle from addressing by the control means upon a failure of the control means to address the vehicle for a particular period of time, sixth means in the vehicle for providing a visual illumination identifying the vehicle and indicating the addressing of the vehicle by the control means, and seventh means including a plurality of switches settable in the vehicle to vary the binary address of the vehicle.

107. In combination in a central station for use with a plurality of pads and with a plurality of vehicles each addressable in accordance with the operation of first controls in any one of the pads and each operable to perform functions in accordance with the operation of second controls in the pad, first means for receiving from the pads signals indicating the operation of the first controls to address the vehicles and signals indicating the operation of second controls to perform the functions in the addressed vehicles, second means responsive to the signals indicating the addressing of the vehicles by the pads for producing first signals addressing the vehicles, and third means responsive to the operation of the second controls in each of the pads for producing the first signals addressing the vehicle even when the central station does not receive from the pad the signals providing for the addressing of the vehicle but receives from the pad the signals indicating the operation of the second controls to perform the functions in the addressed vehicle.

108. In a combination as set forth in claim 107, the second means producing in a binary code the first signals addressing each of the vehicles, and fourth means responsive to the operation of the second controls in each of the pads for producing in a binary code the second signals indicating the functions to be performed in the vehicle addressed by the pad.

109. In a combination as set forth in claim 107, wires extending from the central station to the pads to provide a communication with the pads and to provide power to the pads, and an antenna for providing a wireless transmission of the first and second signals to all of the vehicles in accordance with the operation of the controls in the pads.

110. In a combination as set forth in claim 107, fourth means for discontinuing the operation of each of the vehicles when the pad addressing the vehicle addresses another one of the vehicles or when there is no operation, for a particular period of time after the pad has last produced indications of the functions to be performed in the vehicle, of the controls providing in the pad for the operation of the vehicle.

111. In combination in a vehicle for use with control means having properties of providing packets of signals from a plurality of controlling members, each packet including first signals providing a binary address of the vehicle different from binary addresses for other vehicles and second signals providing binary indications of movement to be provided in the vehicle, the vehicle being usable with transportable elements, first means in the vehicle for decoding the signals in the packets from the control means with the binary address of the vehicle to activate the vehicle, second means responsive in the vehicle to the second signals in the packets from the control means with the address of the vehicle for moving the vehicle in forward and reverse directions and for turning the vehicle to the left and the right, third means in the vehicle for receiving and holding the transportable elements and for providing a release of the transportable elements, and fourth means responsive in the vehicle to the second signals in the packets with the address of the vehicle for operating the third means in receiving, holding and releasing the transportable elements, and fifth means responsive in the vehicle to a failure of the vehicle for a particular period of time to receive any of the second signals from the control means with the address of the vehicle for de-coupling the vehicle from control by the control means until the control means thereafter provides from any of the controlling members the first signals addressing the vehicle.

112. In a combination as set forth in claim 111, sixth means including a plurality of switches manually settable in the vehicle to vary the binary address of the vehicle.

113. In a combination as set forth in claim 111, an antenna for receiving the packets of signals from the control means, the control means providing third signals for releasing the vehicle from control by the control means, and sixth means responsive in the vehicle to the third signals for releasing the vehicle from control by the control means.

114. In combination in a vehicle for use with control means having properties of providing packets of signals, each packet including first signals providing a binary address of the vehicle different from binary addresses for other vehicles and second signals providing binary indications of movement to be provided in the vehicle, the vehicle being usable with transportable elements, first means in the vehicle for decoding the signals in the packets from the control means with the binary address of the vehicle to activate the vehicle, second means responsive in the vehicle to the second signals in the packets from the control means with the address of the vehicle for moving the vehicle in forward and reverse directions and for turning the vehicle to the left and the right, third means in the vehicle for receiving and holding the transportable elements and for providing a release of the transportable elements, and fourth means responsive in the vehicle to the second signals in the packets with the address of the vehicle for operating the third means in receiving, holding and releasing the transportable elements, and fifth means responsive in the vehicle to a failure of the vehicle for a particular period of time to receive any of the second signals from the control means with the address of the vehicle for releasing the vehicle from control by making the vehicle available for selection by any of the control means, sixth means in the vehicle for providing a visual illumination identifying the vehicle and indicating the addressing of the vehicle by the control means during the period of time that the vehicle is being addressed by the control means.

115. In combination in a vehicle for use with control means having properties of providing packets of signals, each packet including first signals providing a binary address of the vehicle different from binary addresses for other vehicles and second signals providing binary indications of movement to be provided in the vehicle, the vehicle being usable with transportable elements, first means in the vehicle for decoding the signals in the packets from the control means with the binary address of the vehicle to activate the vehicle, second means responsive in the vehicle to the second signals in the packets from the control means with the address of the vehicle for moving the vehicle in forward and reverse directions and for turning the vehicle to the left and the right, third means in the vehicle for receiving and holding the transportable elements and for providing a release of the transportable elements, and fourth means responsive in the vehicle to the second signals in the packets with the address of the vehicle for operating the third means in receiving, holding and releasing the transportable elements, and fifth means responsive in the vehicle to a failure of the vehicle for a particular period of time to receive any of the second signals from the control means with the address of the vehicle for releasing the vehicle from control by making the vehicle available for selection by any of the control means, sixth means in the vehicle for providing a visual illumination identifying the vehicle and indicating the addressing of the vehicle by the control means during the period of time that the vehicle is being addressed by the control means, and seventh means including a plurality of switches manually settable in the vehicle to vary the address of the vehicle.

116. In a method at a central station for controlling the movement of a plurality of vehicles in accordance with the addressing of the vehicles by a plurality of pads and in accordance with the operation in the pads of controls to obtain the movement of the vehicles, the steps of:

receiving from the pads first indications of the address of the vehicles and second indications of the movement to be provided in the vehicles, producing first signals indicating the addresses of the vehicles addressed by the pads in accordance with the receipt of the first indications from the pads, producing for each of the addressed vehicles second signals indicating the movements to be provided in the addressed vehicles, combining the first and second signals for each of the vehicles to produce packets of the first and second signals, and transmitting to all of the vehicles the packets of the first and second signals for each of the addressed vehicles to provide for the reception of the signals in the vehicles in accordance with the addresses represented by the first signals in the packets and to provide for the movements of the addressed vehicles in accordance with the second signals in the packets, providing a memory, storing in the memory the selection of the vehicles by the pads, and eliminating from the memory the selection of the vehicles by the pads when the central station fails to receive from the pads for a particular period of time any indications of any functions to be performed by the vehicles.

117. In a method as set forth in claim 116, preventing each of the vehicles from being addressed by one of the pads other than the pad addressing the vehicle.

118. In combination in a vehicle for use with control means having properties of providing packets of signals, each packet including first signals providing a binary address of the vehicle different from binary addresses for other vehicles and second signals providing binary indications of controls to be provided in the vehicle, the vehicle being usable with transportable elements, first means in the vehicle for decoding the first signals in the packets from the control means with the binary address of the vehicle, second means responsive in the vehicle to first ones of the second signals in the packets from the control means with the address of the vehicle for moving the vehicle in forward and reverse directions and for turning the vehicle, third means in the vehicle for receiving, holding and releasing the transportable elements, fourth means responsive to second ones of the second signals in the packets with the address of the vehicle for operating the third means in receiving, holding and releasing the transportable elements, and fifth means in the vehicle for releasing the vehicle from addressing by the control means upon a failure of the control means to address the vehicle for a particular period of time, means for providing for the addressing of the vehicle by any one of the pads when the vehicle fails to receive, for at least a particular period of time, signals from the pad addressing the vehicle.

* * * * *

UNITED STATES PATENT AND TRADEMARK OFFICE

CERTIFICATE OF CORRECTION

PATENT NO. :5,944,609

DATED :Aug. 31, 1999

INVENTOR(S) :John J. Crane, et al.

It is certified that error appears in the above-identified patent and that said Letters Patent is hereby corrected as shown below:

Column 2, lines 11 & 12, change "or blocks marbles", to read --marbles or blocks--.

Column 5, line 60, change "42", to read --42a--.

Column 11, line 24, after "central", add --station--.

Column 12, line 61, before "second", add --first and--.

Column 15, line 57, delete "the", second occurrence.

Column 17, claim 22, line 45, after "provide", add --a--.

Column 17, claim 22, line 47, after "communication", add --of the central station--.

Column 17, claim 23, line 55, remove "the" first occurrence.

Column 18, claim 27, line 32, before "the", remove "pl".

Column 25, claim 60, line 12, change "vehicle", to read --vehicles--.

Column 36, claim 105, line 43, after "time", add --,--.

UNITED STATES PATENT AND TRADEMARK OFFICE

CERTIFICATE OF CORRECTION

PATENT NO. : 5,944,609

DATED : Aug. 31, 1999

INVENTOR(S) : John J. Crane, et al.

It is certified that error appears in the above-identified patent and that said Letters Patent is hereby corrected as shown below:

Column 25, claim 60, line 12, change "vehicle", to read --vehicles--.

Column 36, claim 105, line 43, after "time", add --,--.

Signed and Sealed this

Seventh Day of March, 2000

*Attest:*

*Attesting Officer*

Q. TODD DICKINSON

*Commissioner of Patents and Trademarks*